US005759008A

United States Patent [19]

Smith et al.

[11] Patent Number: 5,759,008

[45] Date of Patent: Jun. 2, 1998

[54] GRIPPING APPARATUS FOR OMNIFARIOUS CONTAINERS

[75] Inventors: Fred P. Smith, Alpine, Utah; Marcel G. Stragier, Scottsdale, Ariz.; Fred T. Smith, Alpine; Kevin L. McAllister, Orem, both of Utah

[73] Assignee: Heil, Chattanooga, Tenn.

[21] Appl. No.: 486,138

[22] Filed: Jun. 7, 1995

Related U.S. Application Data

[60] Division of Ser. No. 158,960, Jan. 19, 1994, Pat. No. 5,482,180, which is a continuation-in-part of Ser. No. 13,774, Feb. 5, 1993, abandoned, which is a continuation-in-part of Ser. No. 728,186, Jul. 10, 1991, Pat. No. 5,209,537.

[51] Int. Cl.[6] ..... B65F 3/04

[52] U.S. Cl. ..... 414/786; 414/406; 414/555

[58] Field of Search ..... 414/406–409, 414/487, 546, 555, 620, 621, 733, 786; 220/500, 523, 553, 555, 669, 675, 908, 909

[56] References Cited

U.S. PATENT DOCUMENTS

| | | | |
|---|---|---|---|
| 4,545,502 | 10/1985 | Reuter | 220/908 X |
| 4,687,405 | 8/1987 | Olney | 220/908 X |
| 4,867,328 | 9/1989 | McCarthy | 220/909 X |
| 5,026,104 | 6/1991 | Pickrell | 294/86.4 |
| 5,152,420 | 10/1992 | Bird et al. | 220/500 X |
| 5,303,841 | 4/1994 | Mezey | 220/909 X |
| 5,490,606 | 2/1996 | Lombardo | 220/908 X |

*Primary Examiner*—James W. Keenan

*Attorney, Agent, or Firm*—Parsons & Goltry; Robert A. Parsons; Michael W. Goltry

[57] ABSTRACT

A pair of elongate, segmented gripping members are carried by the lifting member of a refuse collection vehicle. Each of the gripping members includes an inner arm movably carried by the lifting member and an outer arm movably extending from the inner arm. The gripping members are movable between a retracted position in which the inner arms extend in generally opposite directions, fore and aft along the side of the vehicle, and an extended position in which the inner arms extend in generally the same direction laterally outward from the vehicle. Each outer arm is inwardly movable relative the respective inner arm to draw a container into the embrace of the gripping members. A pair of elongate flexible members engage the container to supplement the grip of the gripping members.

3 Claims, 17 Drawing Sheets

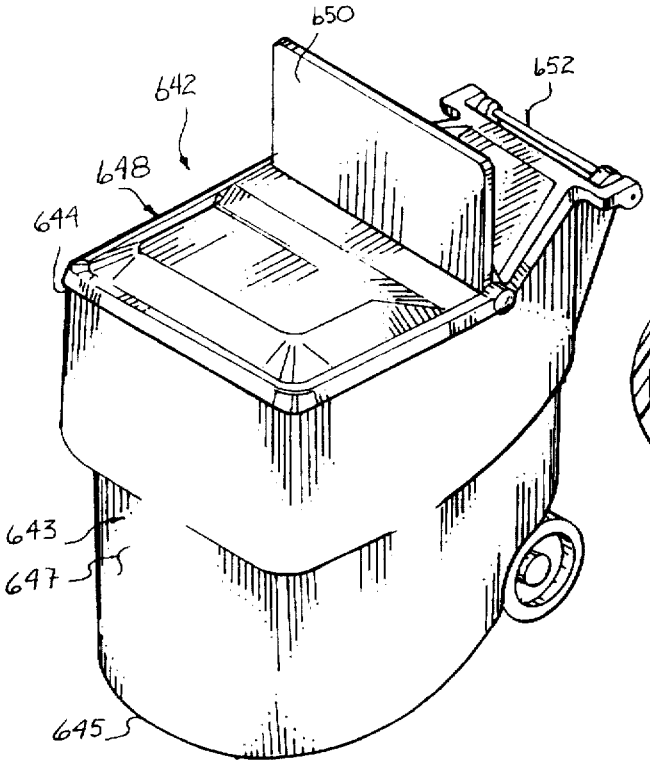
FIG. 42
FIG. 43
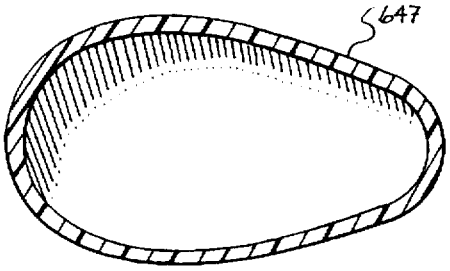

GRIPPING APPARATUS FOR OMNIFARIOUS CONTAINERS

This application is a division of application Ser. No. 08/158,960, filed 19 Jan. 1994, now U.S. Pat. No. 5,482,180, which is a continuation-in-part of application Ser. No. 08/013,774, filed 5 Feb. 1993, abandoned, which is a continuation-in-part of application Ser. No. 07/728,186, filed 10 Jul. 1991 which issued on 11 May 1993, U.S. Pat. No. 5,209,537.

BACKGROUND OF THE INVENTION

1. Field of the Invention

This invention relates to gripping devices.

More particularly, the present invention relates to gripping apparatus of the general type having a pair of opposed gripping members and typically fitted to a refuse collection vehicle.

In a further and more specific aspect, the instant invention concerns an improved gripping apparatus especially adapted for alternately engaging and holding multifarious refuse containers.

2. Prior Art

The collection and disposition of refuse, common commercial and domestic waste and trash colloquially referred to as garbage, has become highly sophisticated, mechanized and automated. Initially, the refuse is deposited and temporarily stored in a conveniently located container. Subsequently, the contents of the container are received by a refuse collection vehicle for ultimate transfer to a disposal site. The vehicle, usually operating on a regular periodic schedule, is generally capable of accommodating numerous containers.

Refuse containers for the instant purpose are readily commercially available in an array of types, sizes and configurations. Common, for example, are stationary containers and portable containers, large containers and small containers, and round containers and square containers. Large round containers, usually permanently positioned at a central location for multiple users, have a capacity ranging to four hundred gallons and a diameter as large as forty-eight inches. Having capacities beginning at approximately thirty gallons and diameters of fifteen inches, small round containers are frequently fitted with wheels for mobility. Square containers, with a transverse measurement in the range of fourteen inches to twenty-nine inches, have a nominal capacity of forty to ninety gallons.

The foregoing measurements and geometric configurations are taken in cross-section at the gripping surface or perimeter which typically reside approximately twenty-eight inches above the supporting surface. In actuality, each container is defined by a continuous, upright sidewall having a taper in the general range of four to seven degrees which accommodates mold release and stacking. Preferably fabricated of polyethylene by various conventional molding processes, the typical container is characterized by a relatively flexible sidewall having a substantially smooth exterior surface.

The conventional refuse collection vehicle basically includes a cab, a body and a container handling mechanism carried upon a wheeled chassis. The container handling mechanism is controllably actuated in response to an on-board source of pressurized hydraulic fluid selectively directed by controls located at the operator's compartment within the cab. The body is generally bipartite, having a hopper and a stowage bin for respectively receiving and stowing refuse. Refuse handling means, usually termed a packer, transfers and compacts refuse from the hopper to the stowage bin.

Typically, the container handling mechanism includes a pair of opposed gripping members carried at the end of a lifting member or boom which is extendable and retractable relative the curb or pick-up side of the vehicle. During travel of the vehicle, the container handling mechanism resides in a retracted position with the gripping members extending in opposite directions, fore and aft, along the side of the vehicle. After the vehicle is brought to a stop, the boom is extended and the gripping members engaged about the container. The boom is then elevated to position the container atilt over the hopper for deposit of the refuse. Successively, the boom is lowered, the container released and the container handling mechanism retracted for stowage during subsequent movement of the vehicle.

The interaction between the container and the container handling mechanism is rife with inherent problems. Initially noted is the engagement of the gripping members which is primarily dependent upon the forces of constriction and friction to lift, tilt and maneuver the container. Insufficient force will result in the container slipping from the grasp of the gripping members, especially during tilting with a resultant fall into the hopper. Conversely, a container is easily subjected to destructive distortion by excessive or improperly applied force.

Another source of considerable concern is the fact that a random, homogeneous mix of containers are frequently utilized within a given geographic area. Conventional prior art gripping members are generally limited to engaging and holding a specifically designated container. Accordingly, the area must be traversed by more than one collection vehicle, or alternately, by a single vehicle on successive trips following alteration of the gripping apparatus.

Various other sources of perturbation are also evident. For example, initial overextension of the boom can tip or push the container beyond reach of the gripping members. Correction is laborious and wasteful. Further noteworthy is the retracted position of container handling apparatus. The exceedingly long gripping members, extending fore and aft, must either reside precariously outboard of the wheels, beyond the legal envelope width, or require a vehicle of considerable wheelbase.

Recently, the increased awareness of recycling has led to a number of innovations and corresponding problems in the refuse collection industry. Refuse collection vehicles have been fitted with divided or compartmented stowage bodies, for collecting and keeping separated the different classes of recyclable refuse such as glass, paper, plastic, organic material, etc. The problems presented by collecting recyclable refuse and depositing it within the appropriate bin of the collection body are numerous.

First, the refuse must be separated before collection. This poses a serious dilemma. If each class of refuse is stored in a separate container prior to collection as is commonly done, each container must be separately emptied into the collection body. While this may not seem overly onerous, the extra time and effort can greatly increase the expense of collecting refuse. Generally, emptying a plurality of individual refuse containers at each stop requires an extra worker to manually emptying the containers into the correct bins, or multiple collection cycles of a container handling mechanism as well as the positioning of the mechanism for each container. In both cases, extra time, effort and expense are expended, making recycling a less attractive proposition.

The above described problem of keeping classes of recyclable refuse separate has been addressed, to some extent, by providing divided refuse containers. These divided containers solve the problem of emptying multiple containers, by storing and keeping separated recyclable refuse in a single container or at least reducing the number of containers required. While divided containers eliminate or reduce the need for multiple collection cycles or manual deposit of refuse, they present the unique problem of emptying the container such that each separate class of recyclable refuse enters the appropriate bin of the collection body.

To successfully empty a divided refuse container, the container handling mechanism must be adjusted to invert the container with each compartment directly over the appropriate receiving bin or hopper of the collection body. Furthermore, the refuse container must be positioned in a specific attitude with respect to the gripping mechanism of the container handling mechanism, to insure proper orientation of the compartments of the container when dumping.

Typically, for a container handling mechanism to properly engage a divided refuse container for oriented dumping, an operator must manually position the divided refuse container. This somewhat defeats the purpose of automated refuse collection normally requiring only one operator, and the development of a single divided container would be pointless. The public may be educated to properly position the divided refuse container for pick-up, but this can be a difficult undertaking, since any deviation of the container from the correct position can result in the operator having to reposition the refuse container or simply by-pass that container. In either case, ill feelings or extra time and effort are generated.

An additional problem presented by divided refuse containers, is the limited capacity for each class of refuse. While the overall capacity of the container is substantially unchanged, its capacity for a single class of refuse is limited. If a household generally has more of one class of refuse than another, a portion of the container may remain unfilled while another portion is filled to capacity, without room for handling the entire volume of refuse.

The prior art has proposed various purported solutions to the foregoing problems. However, none has proven to be entirely satisfactory. It would be highly desirable, therefore, to remedy the foregoing and other deficiencies inherent in the prior art.

Accordingly, it is an object of the present invention to provide an improved gripping apparatus of the type normally used in connection with a refuse collection vehicle.

Another object of the invention is the provision of an improved gripping apparatus especially adapted for engaging and holding refuse containers of diverse cross-sectional configuration and measurement.

And another object of this invention is to provide a gripping apparatus which, without modification or alteration, can alternately grip a variety of containers.

Still another object of the invention is the provision means for securely gripping a wide variety of containers with minimal distortion.

Yet another object of this instant invention is to provide a gripping apparatus having improved means for relatively uniformly distributing the gripping load about the perimeter of a container.

Yet still another object of the invention is the provision of an improved gripping apparatus for applying a generally circumferential compressive gripping force to a refuse container.

A further object of the invention is to provide a gripping apparatus having novel means for extending about and pulling a container into an ameliorated gripping position.

And a further object of the immediate invention is the provision of a gripping apparatus which is more compactly stowable, thereby allowing for a collection vehicle of substantially shortened wheelbase.

Still a further object of the invention is to provide an improved gripping apparatus which can be readily and conveniently retrofitted to a conventional prior art refuse collection vehicle.

And still a further object of the invention is the provision of improvements according to the foregoing which are expediently practiced, fabricated and maintained, in accordance with standard techniques of the art.

Another object of the present invention is to provide a divided refuse container having self aligning capabilities.

And another object of the present invention is to provide a divided refuse container which will turn to a correct orientation relative a gripping apparatus when gripped by the apparatus.

Yet another object of the present invention is to provide a divided container having an overload panel to allow overloading of refuse on said container.

Still another object of the present invention is to provide a divided container having a divider panel which may be adjusted to accommodate individual needs.

SUMMARY OF THE INVENTION

Briefly, to achieve the desired objects of the invention in accordance with a preferred embodiment thereof, first provided are first and second segmented gripping members, each having an inner arm movably affixed to the lifting member of a refuse collection vehicle and an outer arm movably extending from the inner arm. Next provided are actuating means carried by the lifting member for moving the gripping member between a retracted position and an extended position. In the retracted position, the inner arms extend in substantially opposed directions. In the extended position, the inner arms extend in substantially the same direction. Further provided are tensioning means for moving each outer arm inwardly relative the respective inner arm.

Also provided is a self-aligning refuse container for collecting and keeping separate at least a first and a second class of refuse, and for properly aligning said contained refuse for deposit by a container handling mechanism into separate receiving bins. The container includes a body having an open top, a closed bottom, and a gripping portion positioned intermediate the top and the bottom. The gripping portion is substantially oval in cross-section, for aligning the container into a proper orientation for dumping, in response to engagement by the container handling mechanism.

In accordance with a further embodiment of the present invention, a method of collecting refuse comprises providing a self-aligning container including a body having an open top, a closed bottom, and a gripping portion positioned intermediate the top and the bottom. The gripping portion is substantially oval in cross-section, for aligning the container into a proper orientation for dumping, in response to engagement by the container handling mechanism. The gripping portion is engaged with a gripping apparatus so as to properly orient the container relative the gripping apparatus. The step of engaging includes moving the container with the gripping apparatus until a bisecting line of the container is generally congruent with a grip line of the gripping apparatus.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings in which:

FIG. 42 is a perspective view illustrating an alternate embodiment of the self aligning container; and FIG. 43 is a sectional top view illustrating the shape of the gripping portion of the container of FIG. 42.

DESCRIPTION OF THE PREFERRED EMBODIMENT

Figure 1:
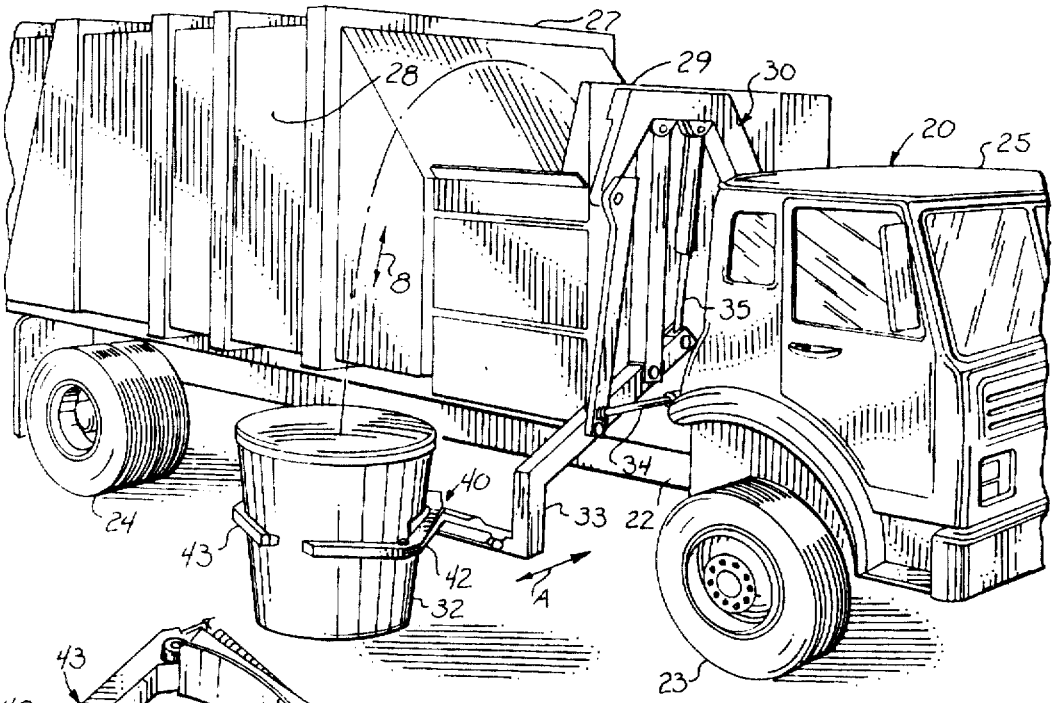
FIG. 1 is a partial perspective view of a refuse collection vehicle fitted with a gripping apparatus embodying the principles of the instant invention, the gripping apparatus being illustrated as it would appear when engaged about a refuse container.

Turning now to the drawings, in which like reference characters indicate corresponding elements throughout the several views, attention is first directed to FIG. 1 which illustrates a conventional prior art refuse collection vehicle generally designated by the reference character 20. Herein viewed from the curb side, vehicle 20 includes a chassis 22 supported and mobilized by a plurality of wheels including front wheels 23 and rear wheels 24 having complimentary mirror images on the opposite or street side of vehicle 20.

Cab 25 and body 27 are carried at spaced apart locations upon chassis 22. Cab 25, enclosing an operators compartment, resides proximate the forward end of chassis 22. Body 27, located upon the rearward portion of chassis 22, includes storage bay 28 and hopper 29. Although not specifically illustrated but as will be appreciated by those skilled in the art, hopper 29 located forwardly of storage bay 28, includes means for compacting and stowing refuse within storage bay 28.

A container handling mechanism, generally designated by the reference character 30, for lifting refuse container 32 and dumping the contents thereof into hopper 29 is carried upon the chassis 22, intermediate cab 25 and body 27. For purposes of exemplification, container handling mechanism 30 is illustrated as having a lifting member or boom 33 which is reciprocally movable in lateral directions, as indicated by the double arrowed line A, between an extended position as shown and a retracted position. Boom 33 is also angularly movable through an upright arc, as indicated by the double arrowed line B, between a lowered position as shown and an elevated position in which container 32 is atilt and substantially above hopper 29.

Double acting hydraulic cylinder assembly 34 urges lateral movement of boom 33. Angular movement is effected by hydraulic cylinder assembly 35. Pressurized hydraulic fluid for selective actuation of the cylinder assemblies is supplied by an on-board source in response to controls located at the operators station within cab 25. Neither the source of pressurized hydraulic fluid nor the controls are specifically illustrated.

Set forth for purposes of orientation and reference in connection with the ensuing detailed description of the preferred embodiment of the instant invention, the foregoing brief description of refuse collection vehicle 20 is intended to be generally representative of typical, prior art, commercially available vehicles of the type. Details not specifically illustrated and described will be readily understood and appreciated by those skilled in the art.

With continued reference to FIG. 1, there is seen a gripping apparatus, generally designated by the reference character 40, embodying the teachings of the instant invention. Preferably carried by the outboard terminal portion of boom 33, gripping apparatus 40 includes a pair of opposed gripping members, first gripping member 42 and second gripping member 43. Specifically shown in the gripping position with gripping members 42 and 43 engaged about container 32, gripping apparatus 40 is selectively actuated in response to the previously described pressurized hydraulic fluid and operator controls.

Figure 2:
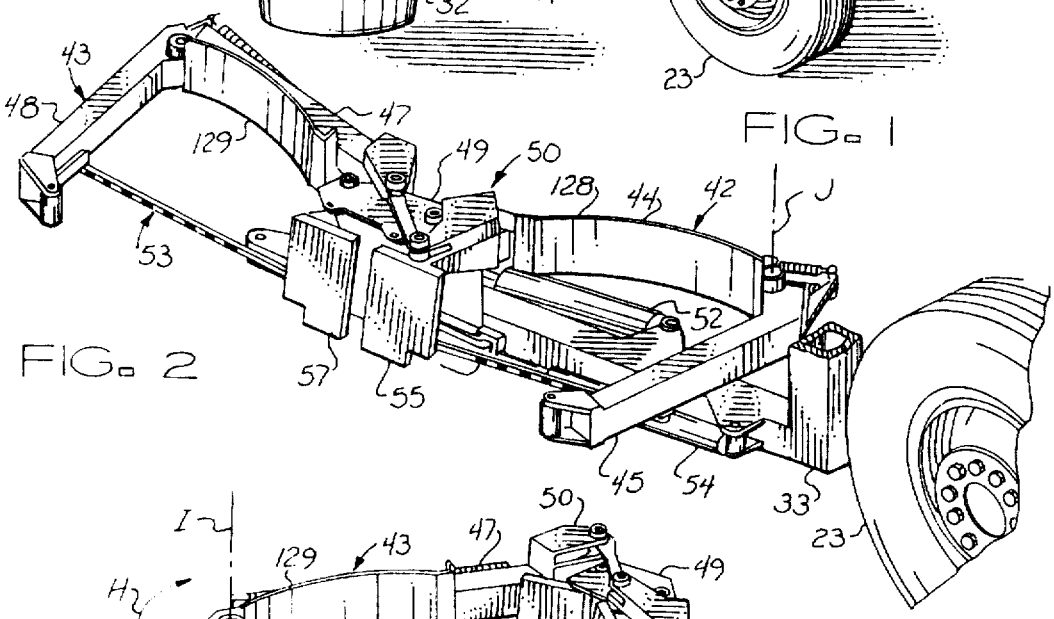
FIG. 2 is an enlarged perspective view of the gripping apparatus of FIG. 1 as it would appear in the retracted position.
Figure 3:
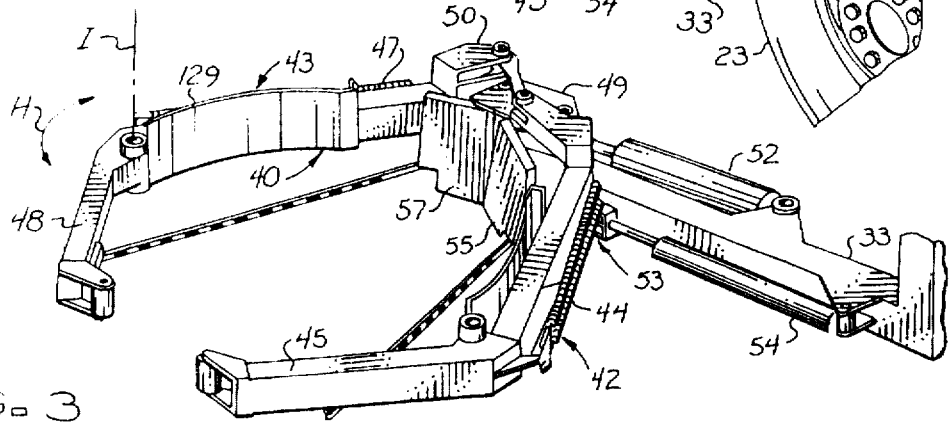
FIG. 3 is a view generally corresponding to the view of FIG. 2 and showing the gripping apparatus thereof in the extended position.

Referring now to FIGS. 2 and 3, it is seen that each gripping member is segmental. Briefly, first gripping member 42 includes inner arm 44 and pivotally connected outer arm 45. Second gripping member 43 similarly includes inner arm 47 and pivotally attached outer arm 48. The pivotal connection between each inner arm and the respective outer arm is rotatable about a substantially vertical axis.

Pedestal 49, carried by boom 33, pivotally supports the inner end of each gripping member for rotation about a substantially vertical axis. Actuating means, generally designated by the reference character 50 and including hydraulic cylinder 52, rotates gripping members 42 and 43 relative pedestal 49. More specifically, actuating means 50 moves the inner arms between the retracted position and the extended position. Tensioning means, generally designated by the reference character 53 and functioning in response to hydraulic cylinder 54, moves each outer arm relative the respective inner arm and assists gripping members 42 and 43 in grasping and holding a refuse container. Pads 55 and 57, carried by pedestal 49, receive the container thereagainst. Further description of the foregoing elements will be made presently.

During travel of vehicle 20, gripping apparatus 40 is normally stowed in the retracted position as specifically illustrated in FIG. 2. Inner arms 44 and 47 extend fore and aft, respectively, and inboard from pedestal 49. Outer arms 45 and 48 extend convergently outboard from the respective inner arms. With boom 33 in the retracted position, gripping apparatus 40 preferably lies inboard of a plane defined by wheels 23 and 24. For engaging a container, first gripping member 42 and second gripping member 43 are extended in response to the operation of actuating means 50 to a position as generally seen in FIG. 3.

Figure 4:
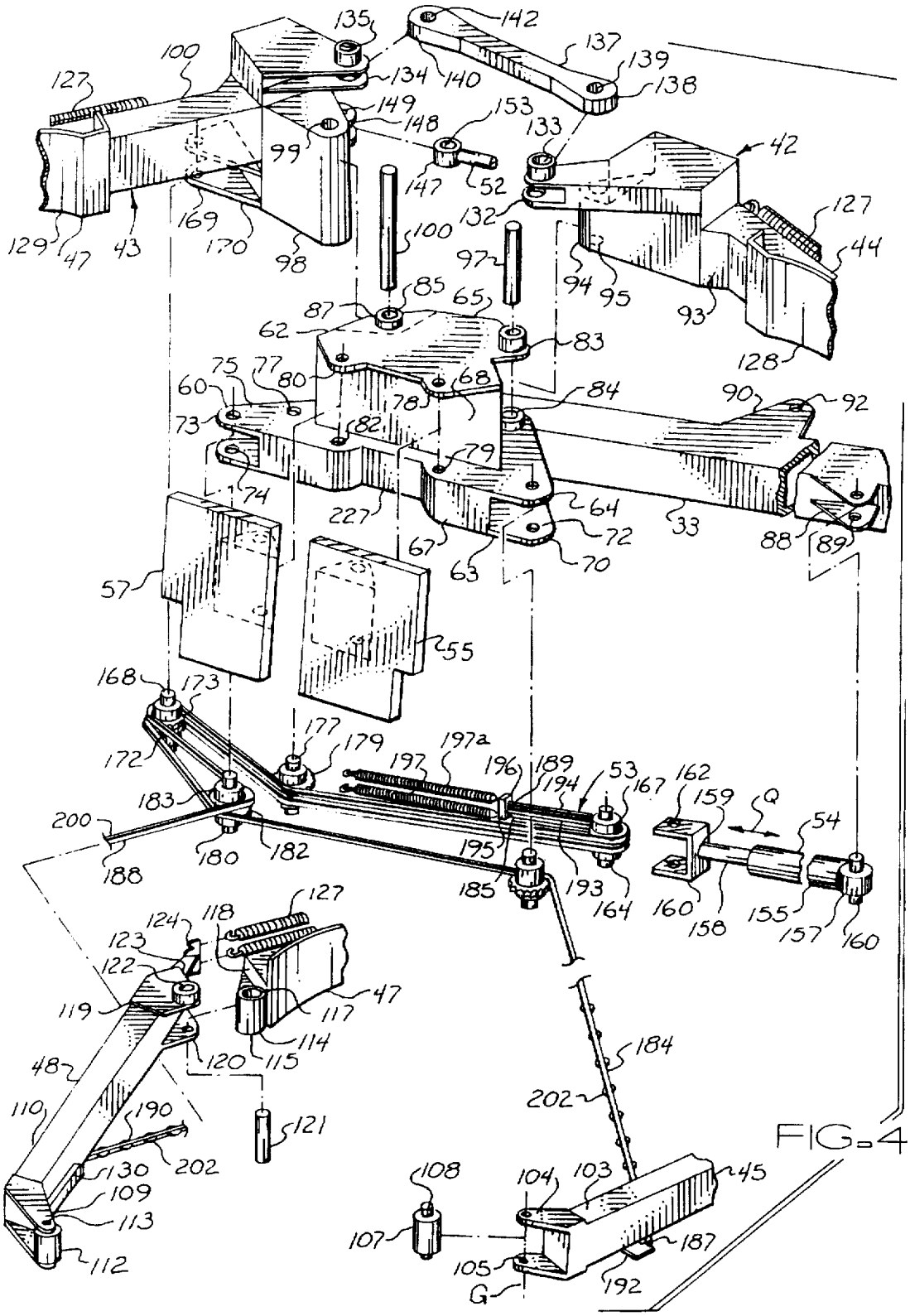
FIG. 4 is an exploded perspective view of the gripping apparatus of the instant invention, portions thereof being broken away for purposes of illustration.

Pedestal 49, more clearly viewed with reference to FIG. 4, includes foundation 60 supporting superstructure 62. Herein chosen for purposes of illustration and ease of manufacture, pedestal 49 is fabricated of three substantially horizontal plates; lower plate 63, intermediate plate 64 and upper plate 65. Spacer 67 holds lower plate 63 and intermediate plate 64 in spaced apart parallel relationship to provide foundation 60. Superstructure 62 includes upper plate 65 held in spaced apart parallel relationship to intermediate plate 64 by riser 68. Other methods of manufacturing pedestal 49, such as machining from solid, molding, casting and forging will readily occur to those skilled in the art.

Foundation 60, projecting generally outboard of boom 33, terminates with forwardly directed bifurcated mounting bracket 70 having bore 72 extending therethrough and with rearwardly directed bifurcated mounting bracket 73 including bore 74. A third, generally rearwardly inwardly directed bifurcated mounting bracket 75 having bore 77 is also carried by foundation 60.

Foundation 60 and superstructure 62, more specifically intermediate plate 64 and upper plate 65, cooperate to form a pair of outwardly directed bifurcated mounting brackets, forward bracket 78 having bore 79 and rearward bracket 80 having bore 82. Similarly, inwardly forwardly directed bifurcated mounting bracket 83 having bore 84 is formed by intermediate plate 64 and upper plate 65. Bifurcated mounting bracket 85, having bore 87 and formed by lower plate 63 and upper plate 64, extends rearwardly inward from pedestal 49. Bifurcated mounting bracket 88 having bore 89 projects outwardly from boom 33 at a location spaced forwardly of pedestal 49. Bifurcated mounting bracket 90 having bore 92 projects inboard from boom 33 at a location spaced forwardly from pedestal 49. Each of the bores associated with the several bifurcated mounting brackets carried by pedestal 49 and boom 33 extend along parallel substantially vertical axes.

Inner end 93 of first gripping member 42, coincidentally the inner end of inner arm 44, terminates with lug 94 having bore 95 therethrough. Lug 94 is sized and shaped to be received within bifurcated bracket 83. Pin 97 passing through bores 84 and 95 pivotally secures first gripping member 42 to pedestal 49 for rotation about the axis represented by the broken line C in directions indicated by the double arrowed arcuate line D as seen with further reference to FIG. 5. Lug 98 having through bore 99, carried at the inner end 100 of second gripping member 43, is received within bifurcated bracket 85 and secured thereto for pivotal movement as represented by the double arrowed arcuate line E about the axis represented by the broken line F. It is noted that the axes represented by the broken lines C and F are substantially spaced for purposes which will be presently described in further detail.

Referring more specifically to FIG. 4, it is seen that outer end 103 of first gripping member 42, coincidentally the outer end of outer arm 45, is bifurcated to form mounting bracket 104. Bore 105 extends through bracket 104 along an axis represented by the broken line G which is substantially parallel to the previously described axes C and F. Roller 107 is rotatably supported within bracket 104 by pin 108 which passes through bore 105. Similarly, bifurcated bracket 109 carried at the outer end 110 of second gripping member 43 rotatably supports cylindrical member 112 by means of pin 113. Each bracket 104 and 109 is turned angularly inward.

Outer end 114 of inner arm 47 of second gripping member 43 terminates with lug 115 having bore 117 therethrough and abutment surface 118. Inner end 119 of outer arm 48 terminates with bifurcated bracket 120 having bore 122 therethrough and complimentary abutment surface 123. Lug 115 is received within bracket 120 and affixed thereto by pin 121 concurrently extending through bores 117 and 122. Accordingly, outer arm 48 is pivotally affixed to inner arm 47 for relative rotational movement as represented by the double arrowed line H seen in FIG. 3. The movement proceeds about an axis represented by the broken line I which is parallel to the previously described axes C, F and G. Although not specifically illustrated, the outer and inner arms of first gripping member 42 are similarly joined for relative rotation about an axis represented by the broken line J in FIG. 2.

Figure 5:
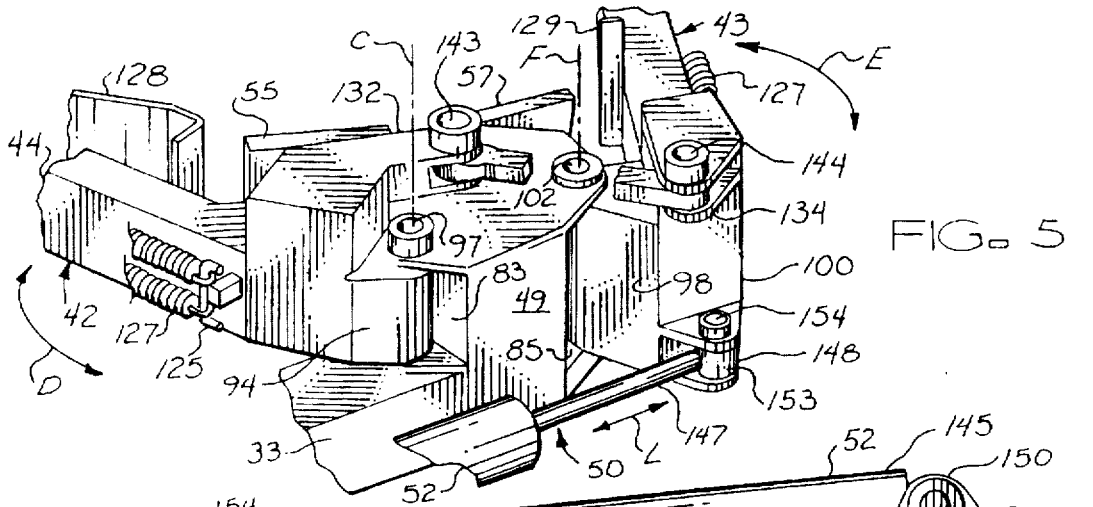
FIG. 5 is a fragmentary perspective view of the central portion of the gripping apparatus as seen in FIG. 3, the view being taken from the rear and on an enlarged scale.

An attachment bracket 124 is cantilevered to extend outwardly rearwardly from the inner end 119 of outer arm 48 as specifically seen in FIG. 4. A complimentary attachment bracket 125, best seen with reference to FIG. 5, is carried on the outboard side of inner arm 44 proximate the inner end 93 thereof. Although not specifically illustrated, it is understood that a mirror image of attachment bracket 124 is carried by outer arm 45. Similarly, a mirror image of bracket 125 is carried by inner arm 47. Tension springs 127 extend between the bracket 124 and the respective complimentary bracket 125 of each gripping member 142 and 143. Accordingly, each outer arm 45 and 48 is normally biased outwardly relative the respective inner arm 44 and 47. The limit of movement, which is rotational about the axis I, is the contact of abutment surface 118 against the respective complemental abutment surface 123.

In accordance with the immediately preferred embodiment of the instance invention, the respective arms of each gripping member, inner arm 44 and outer arm 45 of first gripping member 42 and inner arm 47 and outer arm 48 of second gripping member 43, are straight. Concave panels 128 and 129 are carried on the inner side of inner arms 44 and 47, respectively. Preferably, each panel is an upright cylindrical section. A resilient pad 130 is carried on the inner side of each outer arm 45 and 48 proximate the respective outer end. Similarly, a generally concave configuration is imparted to each outer arm 45 and 48. The bifurcated outer end 104 of outer arm 45 and the bifurcated outer end 109 of outer arm 48 are inturned. Similarly, the bracket 120 carried at the inner end of each of the outer arms is inturned. Further discussion of the generally concave configuration of the inner surface of each of the arms will be made presently.

Actuating means 50 will now be described in detail with particular reference to FIGS. 4, 5, and 6. Bifurcated bracket 132 having bore 133 extending therethrough extends generally inwardly rearward from the inner end 93 of inner arm 44 of first gripping member 42. Bifurcated bracket 134 extends generally rearward from the inner end 98 of inner arm 47 of second gripping member 43. Link 137 couples the inner ends 93 and 98 of first gripping member 42 and second gripping member 43, respectively. First end 138 of link 137 having bore 139 therethrough is received within bracket 132. Second end 140 having through bore 142 is received within bracket 134. Pin 143, extending through bores 133 and 139, pivotally secures first end 138 of link 137 within bracket 132. Similarly, second end 140 of link 137 is pivotally secured within bracket 134 by pin 144 extending through bores 135 and 142. Bracket 132, bracket 134 and link 137 reside in an elevated location spaced above pedestal 49, as particularly seen with momentary reference to FIG. 7.

Hydraulic cylinder assembly 52, including cylinder 145 and operating rod 147, is connected at respective ends to boom 33 and to second gripping member 43. Bifurcated mounting bracket 148 having bore 149 therethrough extends rearwardly from inner end 98 of inner arm 43. In accordance with conventional practice, free end 150 of cylinder 145 is received within mounting bracket 90 and pivotally secured thereto by pin 152 extending through bore 92. Free end 153 of operating rod 147 is pivotally secured within bracket 148 by pin 154.

Hydraulic cylinder assembly 52 is of the double acting type whereby operating rod 147 can be driven in reciprocal directions, as indicated by the double arrowed line L, in response to selective directional application of pressurized hydraulic fluid as will be readily appreciated by those skilled in the art. Bracket 132 functions as a bell crank between pin 97 and pin 143, the axes of rotation of first gripping member 42 and first end 138 of link 137, respectively. Similarly, bracket 134 functions as a bell crank between pin 102 and pin 144. Link 137 extends diagonally forward from pin 144 to pin 143. Accordingly, for movement between the retracted position seen in FIG. 2 and the extended position seen in FIG. 3, hydraulic cylinder assembly 52 is selectively supplied with pressurized hydraulic fluid to extend operating rod 147 in the direction indicated by the arrowed line M in FIG. 6. In response, inner arm 47 of second gripping member 43 rotates inwardly about pin 102 as indicated by the arcuate arrowed line N and drawing link 137 rearwardly as indicated by the arrowed line O. As link 137 moves in the direction of arrowed line O, pin 143 moves rearwardly causing inward rotational movement of inner arm 44 of first gripping member 42 about pin 97 as indicated by the arcuate arrowed line P. For movement from the extended position to the retracted position, hydraulic cylinder assembly 52 is selectively supplied with pressurized hydraulic fluid to retract operating rod 147 resulting in a reversal of the above described movements.

Referring again to FIG. 4, it is seen that hydraulic cylinder assembly 54 of tensioning means 53 includes cylinder 155 having free end 157 and operating rod 158 having free end 159. Free end 157 of cylinder 155 is pivotally carried within bracket 88 by pin 160 extending through free end 157 and residing within bore 89. Clevis 160 having bore 162 extending therethrough is carried at the free end 159 of operating rod 158. Operating rod 158 is telescopically disposed within cylinder 155 for reciprocation along a longitudinal axis as represented by the double arrowed line Q. A conventional commercially available apparatus, hydraulic cylinder assembly 54 is caused to operate in response to the previously noted source of pressurized hydraulic fluid.

Figure 7:
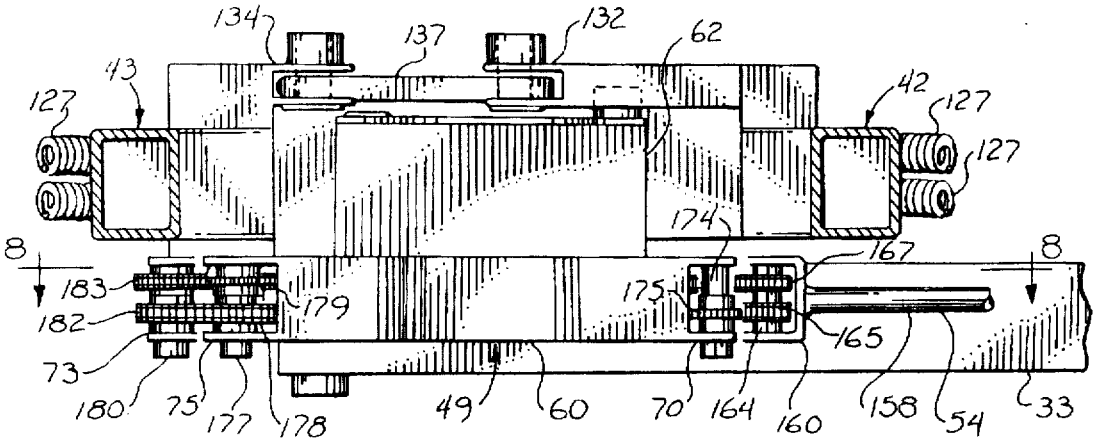
FIG. 7 is a vertical sectional view taken along the line 7—7 of FIG. 6.

Shaft 164, as further illustrated in FIG. 7, is carried within bore 162 of clevis 160 and rotatably supports first and second tandemly arranged sprockets 165 and 167, respectively. Similarly, shaft 168 carried in bore 169 of bifurcated bracket 170 supports tandemly arranged third and fourth sprockets 172 and 173, respectively. For alignment purposes with clevis 160, bracket 170 resides on the under side of inner arm 47 and preferably extends forwardly from the inner end 98 thereof.

Several additional sprockets are rotatably mounted upon the foundation portion 60 of pedestal 49 in alignment with respective ones of the previously described sprockets. With reference to FIGS. 4 and 7, it is seen that shaft 174 rotatably supporting fifth sprocket 175 is carried in bore 72 of bracket 70. Shaft 177 rotatably supporting tandemly arranged sixth sprocket 178 and seventh sprocket 179, is secured within bore 77 of bracket 75. Similarly, shaft 180 is carried within bore 73 of bracket 74 and rotatably supports eighth sprocket and ninth sprocket 182 and 183, respectively. The several sprockets are arranged in two aligned groups. First sprocket 165, third sprocket 172, fifth sprocket 175, sixth sprocket 178 and eighth sprocket 182 comprise a first plurality of aligned sprockets which generally lie in a plane which is substantially perpendicular to the axes of rotation of first gripping member 42 and second gripping member 43. Second sprocket 167, fourth sprocket 173, seventh sprocket 179 and ninth sprocket 183 similarly comprise a second plurality of aligned sprockets generally residing in another plane at an elevation spaced above and parallel to the first plurality of aligned sprockets.

Tensioning means 53, as preferably seen with reference to FIG. 4, further includes first chain 184 having inner end 185 and outer end 187 and second chain 188 having inner and outer ends 189 and 190, respectively. Attachment member 192 secures the outer end 187 of first chain 184 to outer arm 45 of first gripping member 42 at a location spaced from outer end 103. Although not specifically illustrated, outer end 190 of second chain 188 is similarly affixed to outer arm 48 of second gripping member 43. Intermediate the ends, first chain 184 extends about and is engaged with each of the first plurality of aligned sprockets. More specifically, first chain 184, in a direction from outer end 187, passes behind sprocket 175 and is angularly redirected to a forward engagement with eighth sprocket 180. Subsequently, chain 184 is again angularly redirected to reverse direction about third sprocket 172 to be received by the forward portion of sixth sprocket 178. Finally, the direction of first chain 184 is reversed about first sprocket 165. Second chain 188 wends a similar circuitous course about each of the several sprockets comprising the second aligned plurality after first passing behind ninth sprocket 183.

Figure 8:
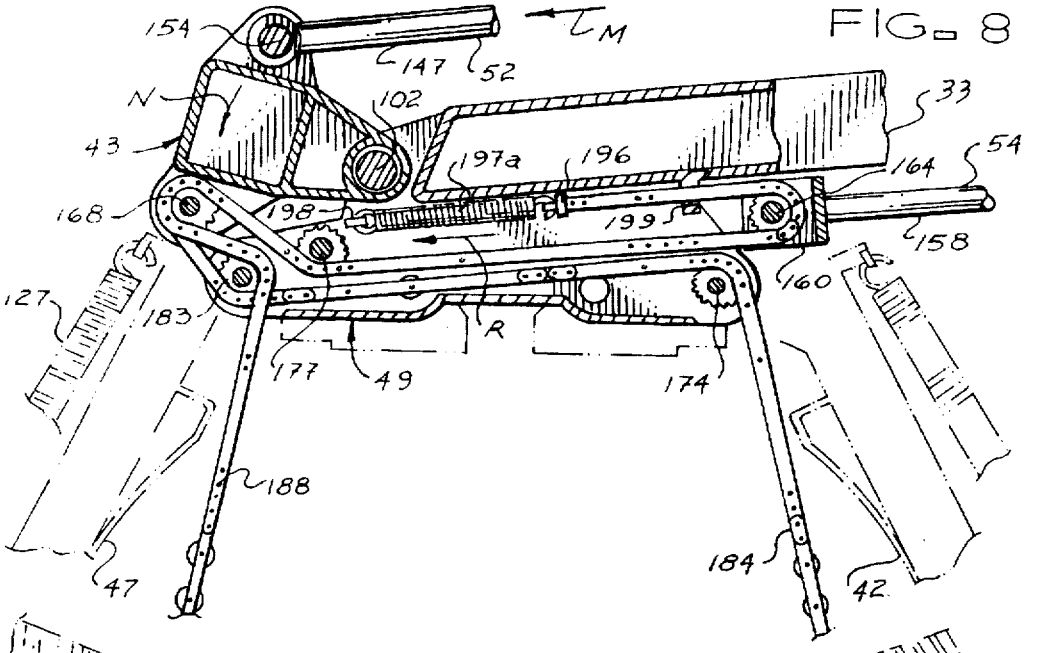
FIG. 8 is a horizontal sectional view taken along the line 8—8 of FIG. 7 and especially showing the gripping apparatus as it would appear in the extended position.
Figure 9:
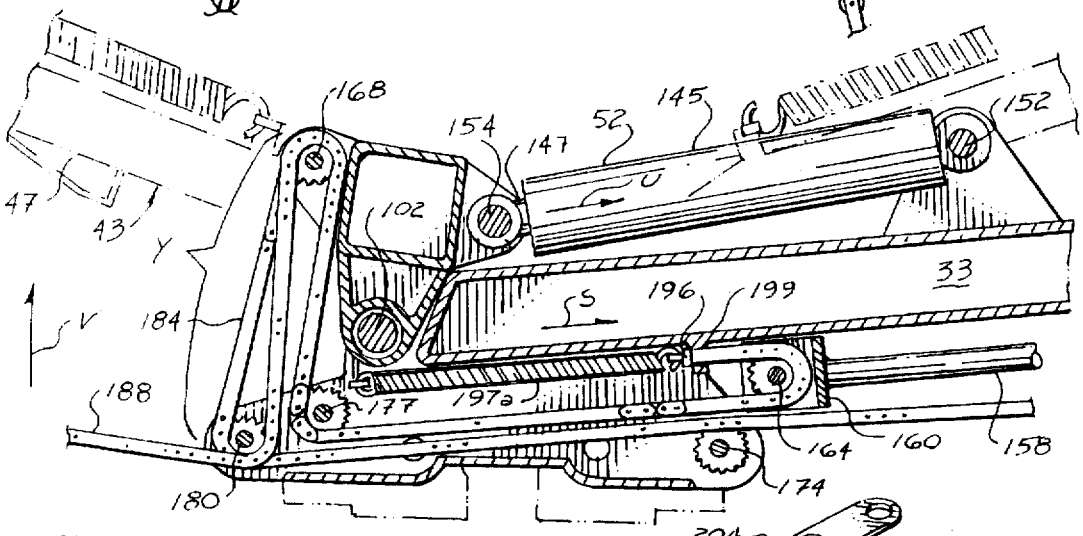
FIG. 9 is a view generally corresponding to the view of FIG. 8 and illustrating the gripping apparatus as it would appear in the retracted position.

First chain 184 concludes with a terminal portion 193 adjacent inner end 185 and extending beyond first sprocket 165. Second chain 188 includes a similar terminal portion 194 adjacent inner end 189 and substantially parallel to the terminal section 193. Block 195 is joined to inner end 185 of first chain 184. Similarly, block 196 is secured to the inner end 189 of second chain 188. Blocks 195 and 196 further function as attachments for one end of the tension springs 197 and 197A, respectively. Referring now to FIG. 8, it is seen that the other end of each tension spring is secured to lug 198 projecting from pedestal 49 to exert tension and normally draw the inner ends of each chain in the direction indicated by the arrowed line R. Although only spring 197A is seen in the immediate illustration, it will be readily appreciated that spring 197 is similarly secured and lies immediately below spring 197A. Similarly, block 195 resides immediately below block 196. Intermediate the ends 185 and 189 and sprockets 165 and 167, the terminal portions 193 and 194 of chains 184 and 188, respectively, pass through apertured stop member 199 projecting from boom 33. Stop member 199 serves as an abutment for receiving the blocks 195 and 196 thereagainst and limiting the extension of springs 197 and 197A in the direction of arrowed lines S as seen in FIG. 9.

Figure 10:
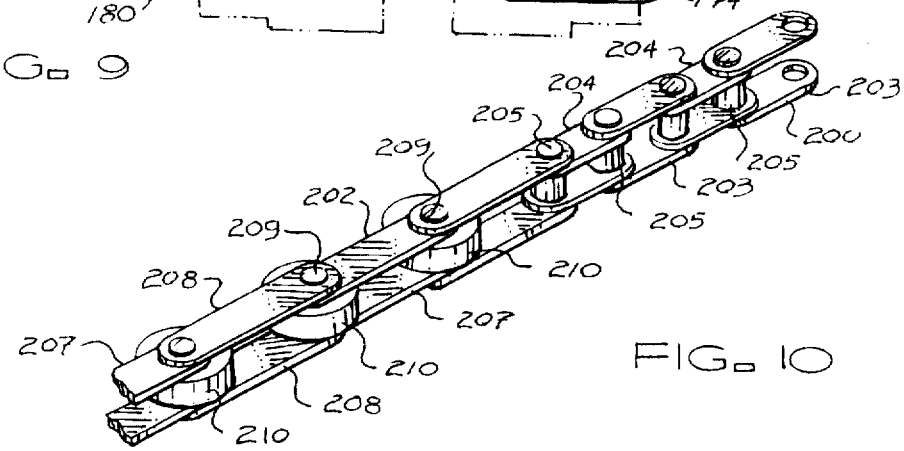
FIG. 10 is a fragmentary perspective view of an elongate flexible member useful in connection with the practice of the instant invention.

With reference to FIGS. 4 and 8, it is seen that first chain 184 and second chain 188 are similarly constructed, each having a first segment 200 extending from the respective inner end and a second segment 202 extending from the respective outer end. Each inner segment 200 as seen in detail in FIG. 10, conventionally includes outer and inner links 203 and 204, respectively, joined by roller pins 205 to engage and function in cooperation with the several previously described sprockets. Outer segment 202 comprises a plurality of overlapping inner and outer links 207 and 208, respectively, joined by pins 209. A cylindrical button 210 is rotatably carried by each pin 209 intermediate opposing links. Each button 210 has a diameter which is greater than the width of each link 207 and 208. The several buttons 210, which may be fabricated of a material having a low coefficient of friction, functions as grip enhancing means unabrasively moving and bearing. It is within the scope of the instant invention that each second segment 200 and 202 may be fabricated of cable, belting or other flexible material. Further description of tensioning means 53 will be made presently.

Referring again to FIGS. 4 and 6, it is seen that pads 55 and 57 are mirror images in structure and in operation. Pad 55 includes rigid backing plate 212 having a front surface 213 and rear surface 214. Facing 215, preferably a sheet of resilient material, is bonded to front surface 213 of backing plate 212. Hinge block 217 projecting from rear surface 214 is sized to be received within bifurcated bracket 78. Pintle 218 extending through hinge block 217 and within bore 79 hingedly affixes pad 55 to pedestal 49. Pad 57 similarly includes backing plate 219 having front surface 220 and rear surface 222. Facing 223 is carried on front surface 220. Hinge block 224 projecting from rear surface 222 is received within bracket 80 and pivotally secured thereto by pintle 225 carried in bore 82.

Pads 55 and 57 are rotatable, as defined by the respective pintles, about axes which are substantially parallel to the axes of rotation of the gripping members 42 and 43. Spacer 67 of pedestal 49 functions as a stop for receiving the rear surface 214 of backing plate 212 and the rear surface 222 of backing plate 219 thereagainst to limit outboard divergent rotation of the pads 55 and 57 to a substantially aligned position with the front surfaces of the respective backing plates substantially lying in a single plane. Concave midsection 227 of spacer 67 receives the inboard edges of plates 55 and 57 during convergent inboard rotation as represented by the arcuate lines T.

Figure 11:
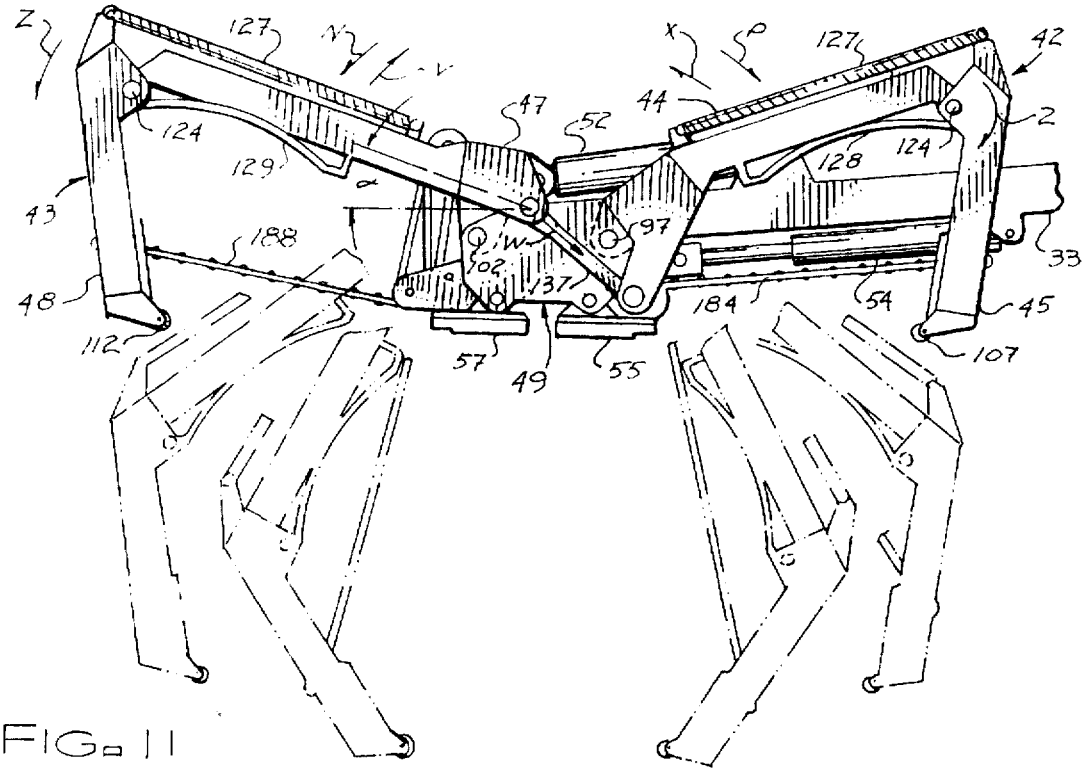
FIG. 11 is a top plan view generally corresponding to the illustration of FIG. 2 and further illustrating, in fragmentary broken outline, sequential movement of the gripping apparatus to the extended position.

Turning now to FIG. 11, the gripping apparatus of the instant invention is illustrated in solid outline as it would appear in the retracted position which is normal for stowage during travel of refuse collection vehicle 20. The device is urged into the retracted position in response to retraction of hydraulic cylinder assembly 52. That is, hydraulic cylinder assembly 52 is selectively and controllably supplied with pressurized hydraulic fluid to telescopingly move operating rod 147 within cylinder 145 in the direction indicated by the arrowed line U in FIG. 9. Drawn by pin 154 which is movable with operating rod 147, inner arm 47 of second gripping member 43 rotates about pin 102 in the direction indicated by the arcuate arrowed line V. With cylinder 52 in the fully retracted position, inner arm 47 resides at a location which is rearwardly inboard with reference to vehicle 20 as represented by the angle alpha. Concurrently, link 137 pushed by pin 144 to move in a direction indicated by the arrowed line W bears against pin 143 causing inner arm 44 of first gripping member 42 to rotate about pin 97 in the direction indicated by the arrowed arcuate line X. At the terminus of movement to the fully retracted position, inner arm 44 extends forwardly inboard to rest at a position which is a substantial mirror image of the position of inner arm 47.

Chains 184 and 188 are of finite length. With inner arm 47 in the retracted position, pin 168, carrying sprockets 172 and 173, resides at a location which is substantially spaced from shaft 177 carrying sprockets 178 and 179 and from shaft 180 carrying sprockets 182 and 183. The relative spacing of the respective sprockets creates a doubled length of the chains within the space represented by the bracket designated Y in FIG. 9. The effectively shortened chains exert tension upon the respective outer arms. More specifically, chain 188 causes rotational movement of arm 48 about pin 124 in a direction as indicated by the arcuate arrowed line Z against the biasing of spring 127. Correspondingly, outer arm 45 is rotated about pin 124 as indicated by the arcuate line Z in response to chain 184. Ultimately, outer arms 45 and 48 extend convergently outboard in substantial mirror image.

Figure 6:
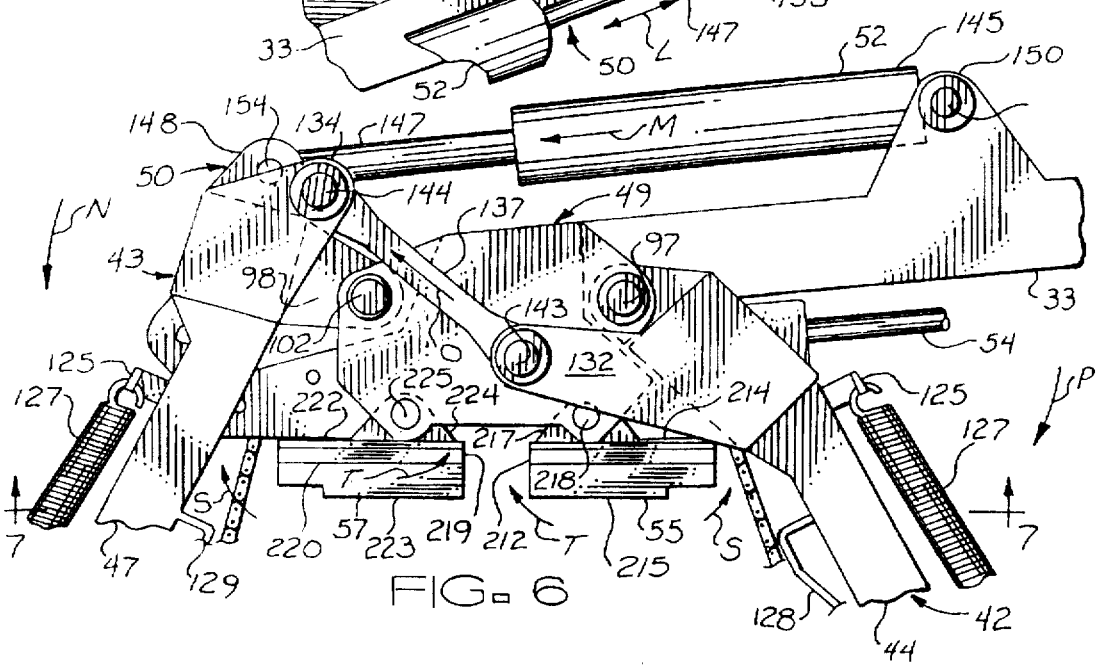
FIG. 6 is a top plan view generally corresponding to the view of FIG. 4.

The gripping apparatus is moved from the retracted position to the extended position in response to pressurized hydraulic fluid being selectively supplied to hydraulic cylinder assembly 52 whereby operating rod 147 is extended in the direction indicated by the arrowed line M in FIG. 6. The movement of operating rod 147 rotates inner arm 47 about pin 102 in a generally outboard direction as indicated by the arcuate arrowed line N. Concurrently, link 137 moves in the direction of arrowed line O causing inner arm 44 to rotate about pin 97 in the direction indicated by the arcuate arrowed line P for synchronous movement with inner arm 47.

As inner arm 47 rotates in the extending direction, pin 168 continuously moves closer to pins 177 and 180 thereby progressively decreasing the length of double chain and simultaneously, progressively increasing the effective overall length of chains 184 and 188. Springs 127, functioning in synchronous opposition with the chains 184 and 188, rotate the outer arms 45 and 48 outwardly about the respective pins 121. Ultimately, the complemental abutment surface carried by each outer arm contacts the abutment surface 118 of each respective inner arm to increase the angle therebetween as shown in broken outline in FIG. 11.

Figure 12:
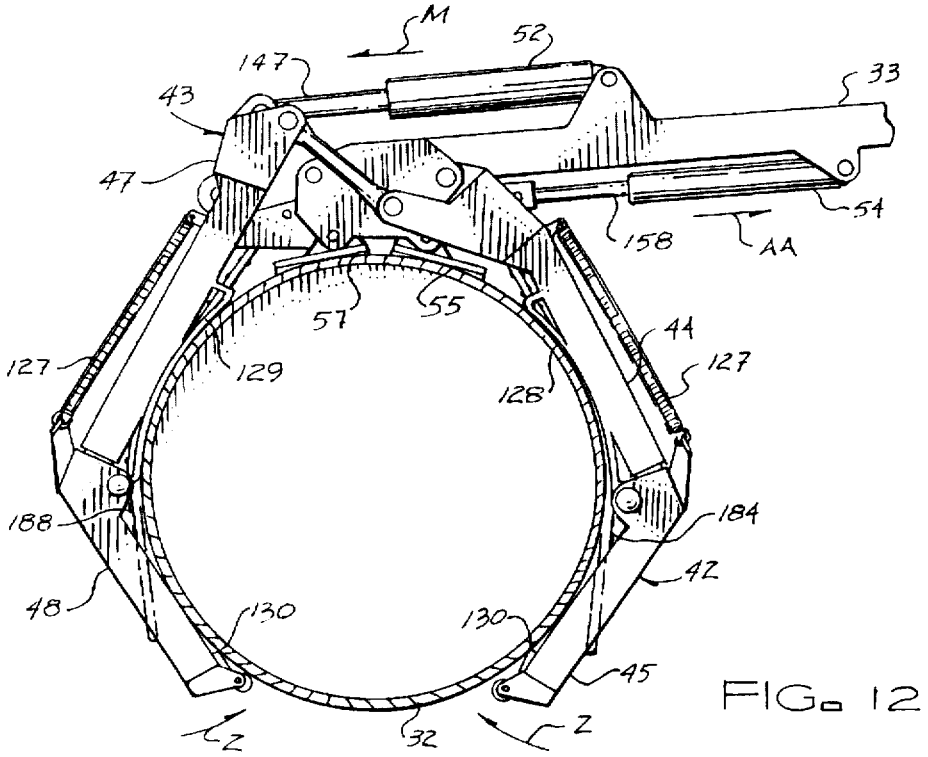
FIG. 12 is a view generally corresponding to the view of FIG. 11 and showing the gripping apparatus thereof as it would appear when engaged about a large cylindrical container, the container being shown in horizontal sectional view.

Movement between the retracted position and the extended position shown in solid outline and broken outline, respectively, in FIG. 11 proceeds until the gripping members 42 and 43 are engaged about container 32 as seen in FIG. 12. As a result of the spacing between axes C and F, as seen in FIG. 5, the respective axes of rotation of inner arms 44 and 47, respectively, the gripping members exhibit a greater tendency to embrace than push the container. Chosen for exemplary purposes, container 32 is generally illustrative of the commercially available relatively large cylindrical type having a capacity of approximately 400 gallons and a diameter of approximately 41 inches. The initial contact of first gripping member 42 and of second gripping member 43 with container 32 may be relatively random. In other words, initial contact may be made by concave members 128 and 129, chains 184 and 188 or pads 130. Operating rod 147 of hydraulic cylinder assembly 52 continues to extend in the direction indicated by the arrowed line M until gripping members 42 and 43 exert a predetermined pressure upon container 32. For purposes of orientation and reference, this is generally considered the termination of the extension phase of operation.

Subsequently, hydraulic cylinder assembly 54 is actuated to urge operating rod 158 in the direction indicated by the arrowed line AA extending springs 197 and 197A and bringing the respective blocks 195 and 196 into engagement with stop member 199. Again, for purposes of orientation and reference, this is considered the initiation of the gripping phase of operation. As will be readily appreciated, the extension phase and the gripping phase may overlap or progress concurrently.

Continued movement of operating rod 158 simultaneously shortens the effective length of chain 184 and of chain 188. As the chains are effectively shortened, outer arm 45 and outer arm 48 are rotated inwardly as represented by the arcuate 26 arrowed lines Z. As the movement of outer arms 45 and 48 continues, container 32 is urged inwardly by pads 130 to be firmly seated in concave panels 128 and 129 and against pads 55 and 57. Hydraulic cylinder assembly 54 continues to operate to a predetermined pressure at which time chains 184 and 188 also exert a gripping force upon container 32. The chains, being independently tensioned by the respective springs and simultaneously tensioned by hydraulic cylinder assembly 54, function correspondingly but independently to accommodate any irregularities in the load to be gripped as will be further appreciated from the description which follows. The container is now ready to be lifted and tilted for dumping.

In a conventional refuse collection vehicle, the on-board hydraulic system typically provides hydraulic fluid which is pressurized to within a range of two thousand pounds per square inch (PSI) to three thousand PSI. Hydraulic cylinder assembly 52, having a preferred nominal diameter of three inches, is capable of exerting more than twenty thousand pounds of force. Having a preferred diameter of two inches, hydraulic cylinder 54 assembly is capable of exerting a force of more than nine thousand pounds. In accordance with the immediately preferred embodiment of the instant invention, actuation of hydraulic cylinder assembly 54 is initiated when hydraulic cylinder assembly 52 has achieved a pressure of approximately one thousand two hundred PSI exerting and extending force of about eight thousand five hundred pounds.

Various means for sequentially performing the extension and gripping functions will readily occur to those skilled in the art. The supply of pressurized hydraulic fluid to hydraulic cylinder assembly 52 and the supply of pressurized hydraulic fluid to hydraulic cylinder assembly 54 may be under separate control for selective manipulation by the operator. It is preferred, however, that the hydraulic cylinder assemblies be interconnected by a sequence valve whereby the flow of pressurized fluid is first directed to hydraulic cylinder assembly 52 and subsequently to hydraulic cylinder assembly 54 when a predetermined pressure is attained.

Figure 13:
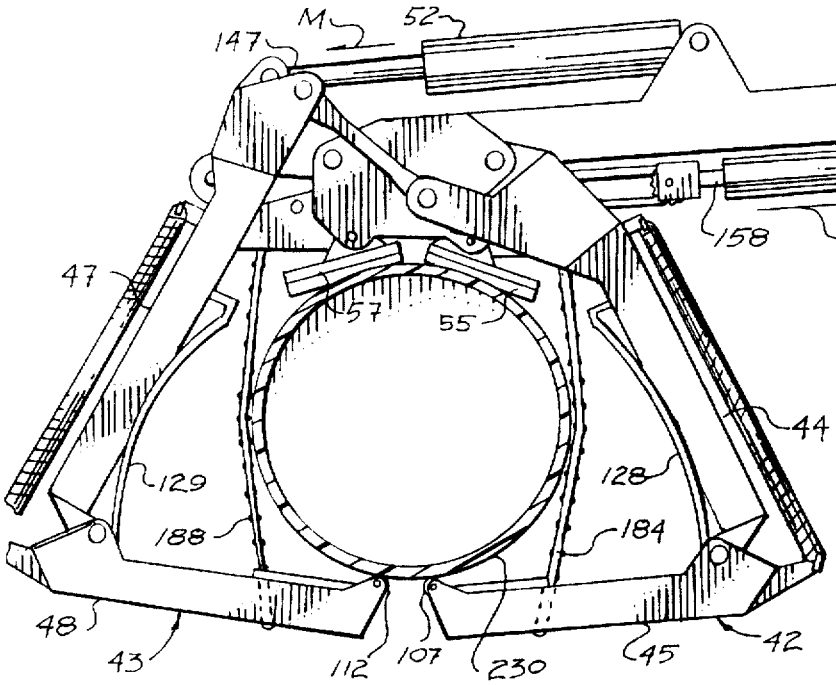
FIG. 13 is a view generally corresponding to the illustration of FIG. 12 and showing the gripping apparatus as it would appear when engaged about a small cylindrical container, the container being shown in horizontal sectional view.

Referring now to FIG. 13, there is illustrated a conventional prior art container 230 of the type usually referred to as "small, round", having a capacity of approximately fifty gallons and a diameter of approximately twenty-two inches. In gripping container 230, the gripping apparatus of the instant invention sequentially functions generally as previously described in connection with the gripping of container 32. At the limit of travel of operating rod 147, the attainment of the predetermined maximum pressure within hydraulic cylinder assembly 52, inner arms 44 and 47, more specifically concave plates 128 and 129, are spaced from container 230. In response to subsequent movement of operating rod 158 of hydraulic cylinder assembly 54 in the direction indicated by the double arrowed line AA, outer arms 45 and 48 are rotated inwardly by tensioning means 53, bringing rollers 107 and 112 into contact with container 230, drawing container 230 into contact with pads 55 and 57. Activation of hydraulic cylinder assembly 54 is continued until attainment of the predetermined maximum pressure at which time container 230 is firmly gripped between rollers 107 and 112 and pads 55 and 57 and between chains 184 and 188. Buttons 210 enhance the grip of chains 184 and 188, and retard marring or damage of container 230 by links 207 and 208.

Figure 14:
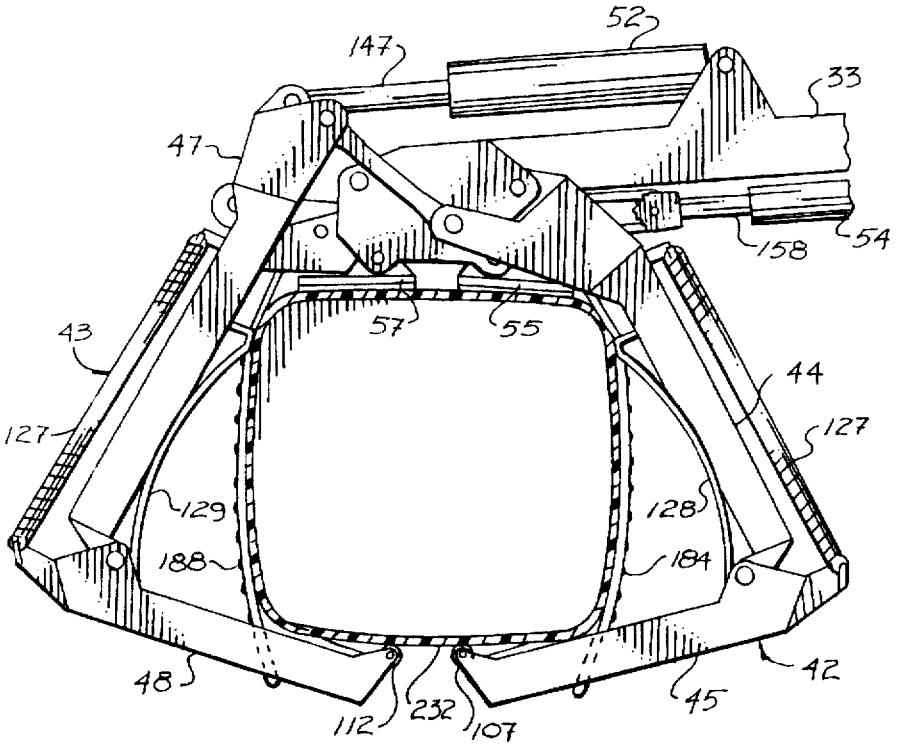
FIG. 14 is another view generally corresponding to the view of FIG. 12 and especially illustrating the gripping apparatus as it would appear when engaged about a rectangular container.

Illustrated in FIG. 14 is another prior art container designated by the reference character 232. Being generally square, container 232 has a nominal capacity of approximately ninety gallons and a transverse measurement of approximately twenty-six inches. The sequential operation of the gripping apparatus of the instant invention during engagement with container 232 is analogous to the operation of gripping container 230 as set forth in connection with the description of FIG. 13.

Figure 15:
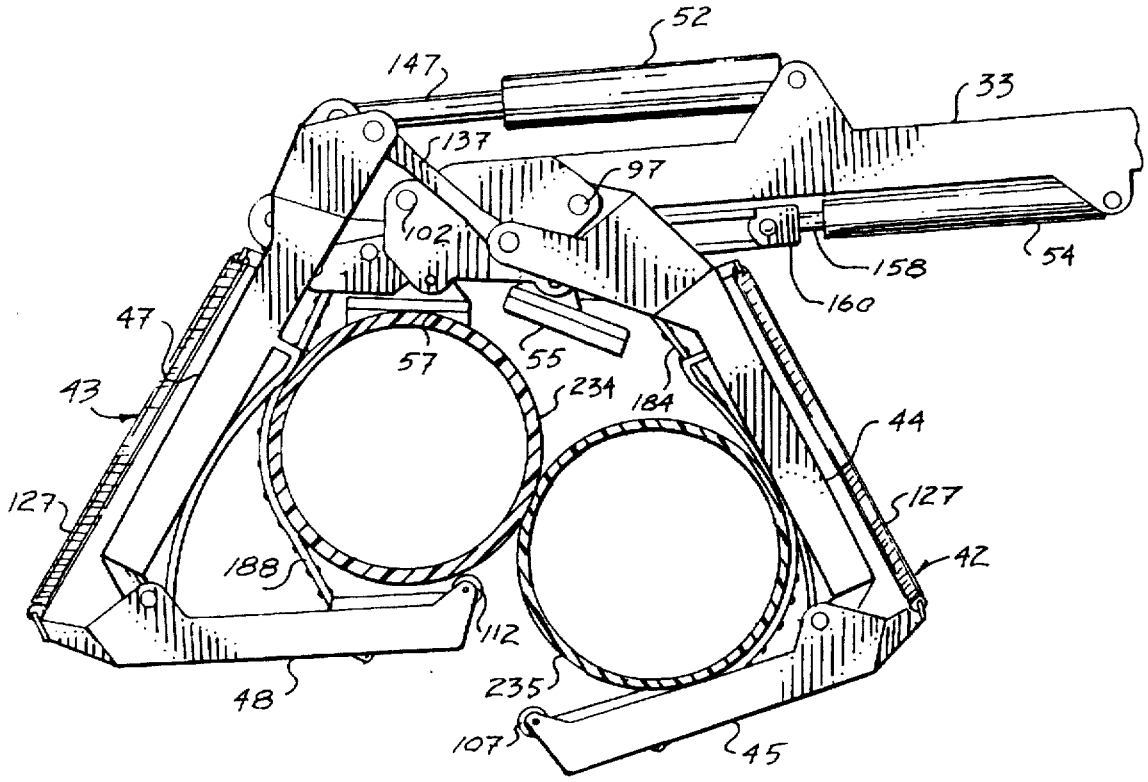
FIG. 15 is still another view generally corresponding to the view of FIG. 12 and especially illustrating the gripping apparatus as it would appear when engaged about a pair of small containers.

Being omnifarious, the gripping apparatus of the instant invention is capable of simultaneously gripping and holding more than one container. Turning now to FIG. 15, there is seen a possible configuration this apparatus may assume when concurrently engaging two containers, herein shown as small round containers 234 and 235. Although the containers abut, each is primarily engaged by a respective arm of the gripping members, which function cooperatively, yet independently, as a result the individual tensioning of the respective chains.

Figure 16:
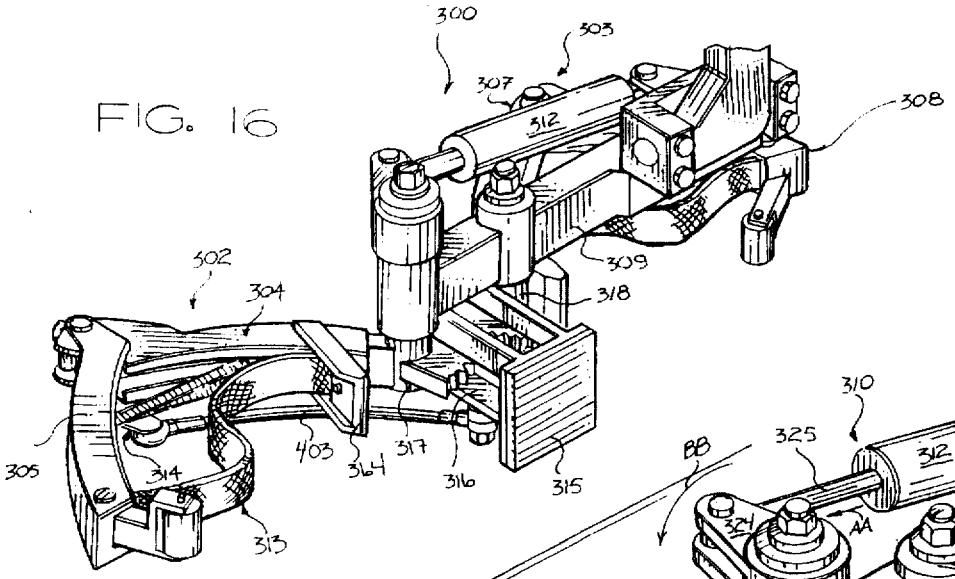
FIG. 16 is a perspective view of an alternate embodiment of a gripping apparatus as it would appear in the retracted position.

Turning now to FIG. 16, a further embodiment of a gripping apparatus generally designated 300 is illustrated. It will be understood by those skilled in the art that gripping apparatus 300 may be carried by the outboard terminal portion of boom 33 as is gripping apparatus 40 illustrated in FIG. 1. Gripping apparatus 300 includes first and second gripping members 302 and 303 respectively, which are illustrated in the extreme release or travel position. Each gripping member 302 and 303 is a mirror image of the other. Accordingly, in the following detailed description it is to be understood that elements and function described in connection with one of the gripping members is correspondingly applicable to the other.

Briefly, gripping member 302 includes inner arm 304 and pivotally connected outer arm 305. Gripping member 303 similarly includes inner arm 307 and pivotally attached outer arm 308. The pivotal connection between each inner arm and the respective outer arm is rotatable about a substantially vertical axis.

A pedestal 309, carried by boom 33, pivotally supports the inner end of each gripping member for rotation about a substantially vertical axis. Actuating means generally designated by the reference character 310, including hydraulic cylinder assembly 312, rotates gripping members 302 and 303 relative pedestal 309. More specifically, actuating means 310 moves the inner arms between the retracted position and the extended position. Tensioning means, generally designated by the reference character 313, moves each outer arm inwardly relative the respective inner arm and assists gripping members 302 and 303 in grasping and holding a refuse container, distributing the gripping force substantially equally around the periphery of the refuse container. Extension means, generally designated 314 moves each outer arm outwardly relative the respective inner arm. Pads 55 and 57, may be used as in gripping apparatus 40, however in this preferred embodiment a single pad 315 is carried by an extension 316 projecting substantially horizontally outward from pedestal 309 for receiving the refuse container thereagainst. Further description of the foregoing elements will be made presently.

During travel of vehicle 20, gripping apparatus 300 is stored in a manner similar to that illustrated for apparatus 40 in FIG. 2.

Figure 18:
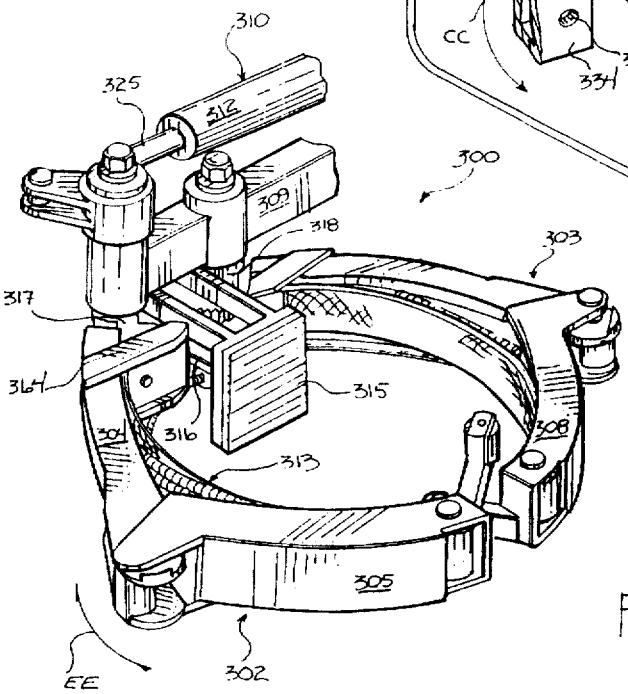
FIG. 18 is a perspective view of the gripping apparatus of FIG. 16 as it would appear in the extended position.

Actuating means 310 is carried by pedestal 309. Actuating means 310 includes first and second shafts 317 and 318 which are parallel and rotatably journaled within pedestal 309. Segment gear 319 and mounting bracket 320 are carried by shaft 317 for rotation therewith. Similarly, segment gear 322 and mounting bracket 323 are carried by shaft 318. Lever 324 is drivingly engaged at one end thereof, to shaft 318. An operating rod 325 of hydraulic cylinder assembly 312 is pivotally connected to the other end of lever 324. Gripping apparatus 300 is moveable between a release position and a gripping position. The release position is illustrated in FIG. 16, the gripping position is illustrated in FIG. 18. In response to movement of operating rod 325 in the direction of arrowed line AA', lever 324 is caused to move in the direction of arrowed line BB urging counter rotation of shafts 317 and 318. Accordingly, mounting brackets 320 and 323 move in the directions indicated by arrowed lines CC and DD respectively, moving inner arms 304 and 307 to the retracted position and gripping apparatus 300 to the gripping position of FIG. 18.

Figure 17:
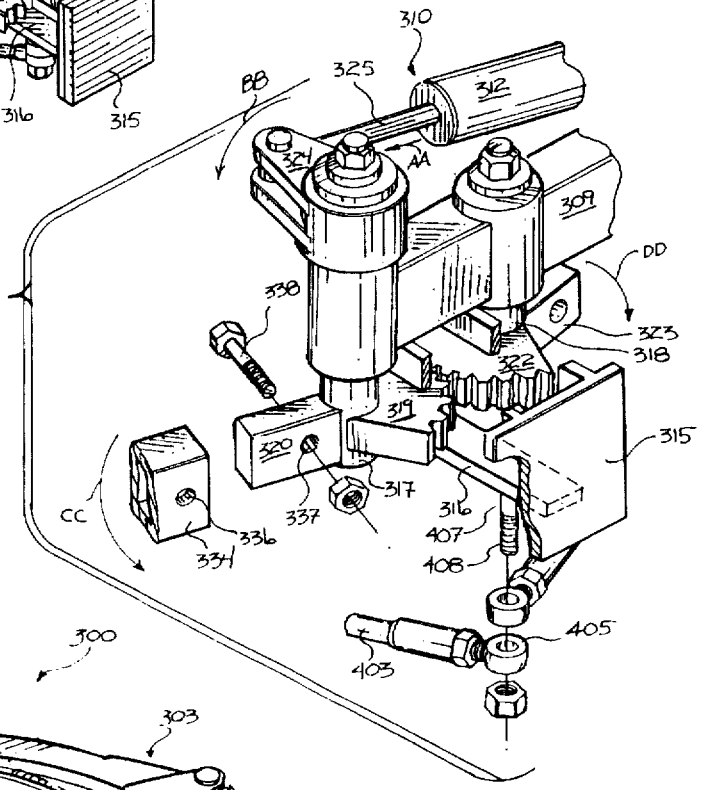
FIG. 17 is an enlarged fragmentary perspective view of the extension means of the gripping apparatus illustrated in FIG. 1.
Figure 19:
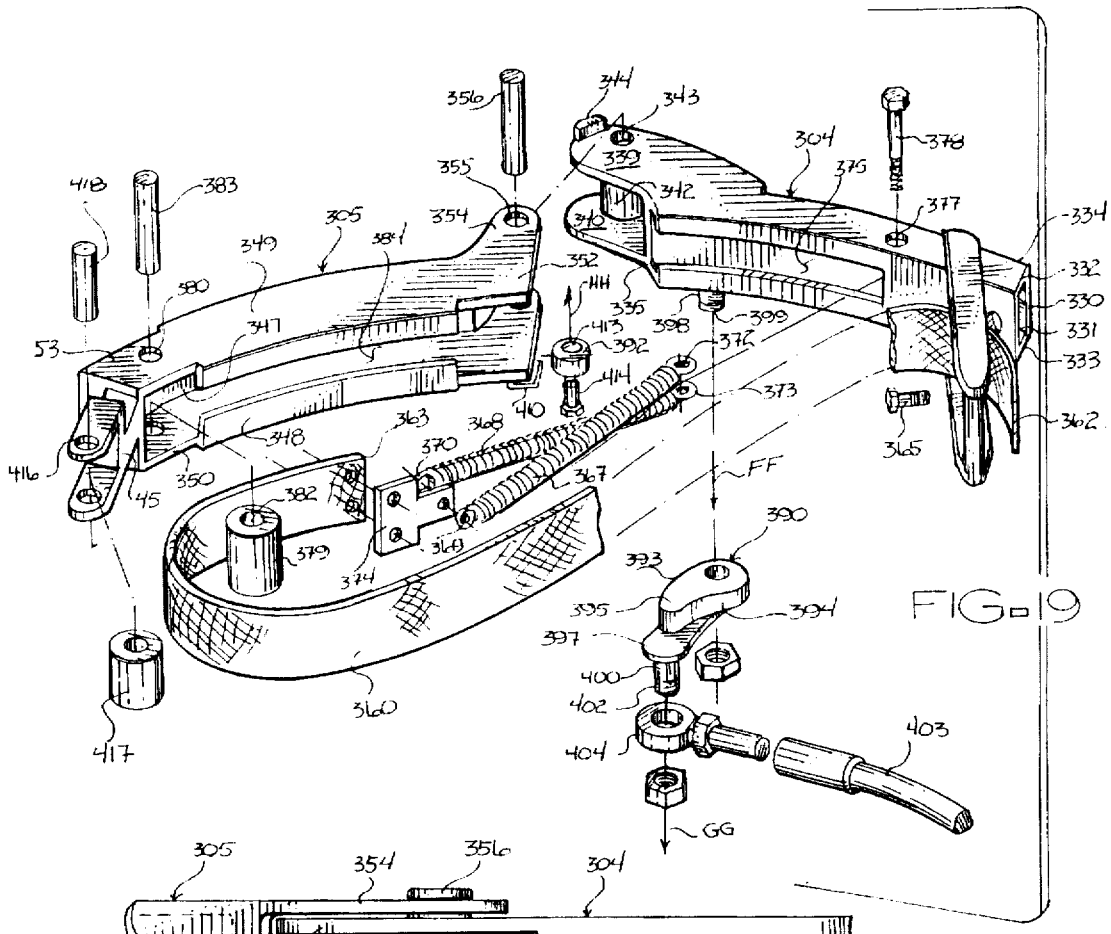
FIG. 19 is an exploded partial perspective view of a gripping member of the gripping apparatus illustrated in FIG. 16.

Turning now to FIG. 19, gripping member 302 is illustrated. While the following description will be directed to gripping member 302, it will be understood that gripping member 303 is substantially a mirror image and intended to match the description of gripping member 302 unless specifically stated otherwise, and is therefore not specifically described. Inner arm 304 of gripping member 302 is an elongate member, which in this embodiment is a substantially square tube having an outer wall 330, an inner wall 331, a top wall 332, a bottom wall 333, an inner end 334, and an outer end 335. With additional reference back to FIG. 17, inner end 334 of first gripping member 302 includes a bore 336 therethrough. A corresponding bore 337 extends through mounting bracket 320. Inner end 334 is configured to receive mounting bracket 320 therein, so as to position bore 336 and 337 in a lignment. A nut and bolt assembly 338 extends through, bores 336 and 337, securing gripping member 302 to mounting bracket 320.

Still referring to FIG. 19, an upper ear 339 and a lower ear 340, parallel to and spaced apart from upper ear 339, extend outward from outer wall 330 proximate outer end 335. Ears 339 and 340 are turned angularly forward, extending past outer end 335. A bushing 342 extends between ears 339 and 340, defining a bore 343. A stop 344 projects upward from upper ear 339 and will be explained in greater detail below.

Outer arm 305 of gripping member 302 is an elongate member, which in this embodiment is a substantially square tube having an outer wall 347, an inner wall 348, a top wall 349, a bottom wall 350, an inner end 352, and an outer end 353. Inner end 352 of outer arm 305 terminates with a bifurcated bracket 354 extending outwardly therefrom, having a bore 355 therethrough. Bifurcated bracket 354 is turned angularly rearward, and configured to receive ears 339 and 340 therebetween. Ears 339 and 340 are received within bracket 354 and affixed thereto by a pin 356 concurrently extending through bores 343 and 355. Accordingly, outer arm 305 is pivotally affixed to inner arm 304 for relative rotational movement as represented by double arrowed line EE seen in FIG. 18.

Tensioning means as described for embodiment 40 biases the outer arm inward relative the inner arm, and in this embodiment, includes a flexible member 360 having a first end 362 and a second end 363. First end 362 is attached to an anchor member 364 extending inwardly from inner arm 304 proximate inner end 334 by a bolt 365. Those skilled in the art will understand that while an anchor member is being used in the preferred embodiment, attaching first end 362 directly to inner arm 304 is a possible alternative. Second end 363 is attached to inner arm 304 by biasing means, which in this embodiment is a pair of tension springs 367 and 368 each having a first end terminating in a ring 369 and 370 respectively and a second end terminating in a ring 372 and 373 respectively. A T-shaped reinforcing plate 374 couples rings 369 and 370 of the first ends of springs 367 and 368 to second end 363 of flexible member 360. The second end of springs 367 and 368 are inserted into the interior of inner arm 304 through a slot 375, formed in inner wall 331, which extends from outer end 335 to a point spaced apart from inner end 334. A bore 377 extends through top wall 332 and communicates with the interior of inner arm 304 intermediate inner end 334 and outer end 335. The second ends of springs 367 and 368 are inserted through slot 375 and pivotally attached within inner arm 304 by a bolt 378 concurrently extending through bore 377 and rings 372 and 373.

Flexible member 360 passes around a cylinder 379 rotatably mounted within outer arm 305 proximate outer end 353. A bore 380 extends through top wall 349 and bottom wall 350 proximate outer end 353. A bore 382 extends through cylinder 379 which is rotatably attached by a pin 383 concurrently extending through bore 380 and bore 382. Flexible member 360 passes around cylinder 379, which acts as a pulley, and extends inwardly through the interior of outer arm 305 and is attached by biasing means to inner arm 304 proximate anchor 364. Outer arm 305 has a slot 384 formed in inner wall 348 through which flexible member 360 gains access to the interior. Slot 384 extends substantially the entire length of outer arm 305.

Figure 20:
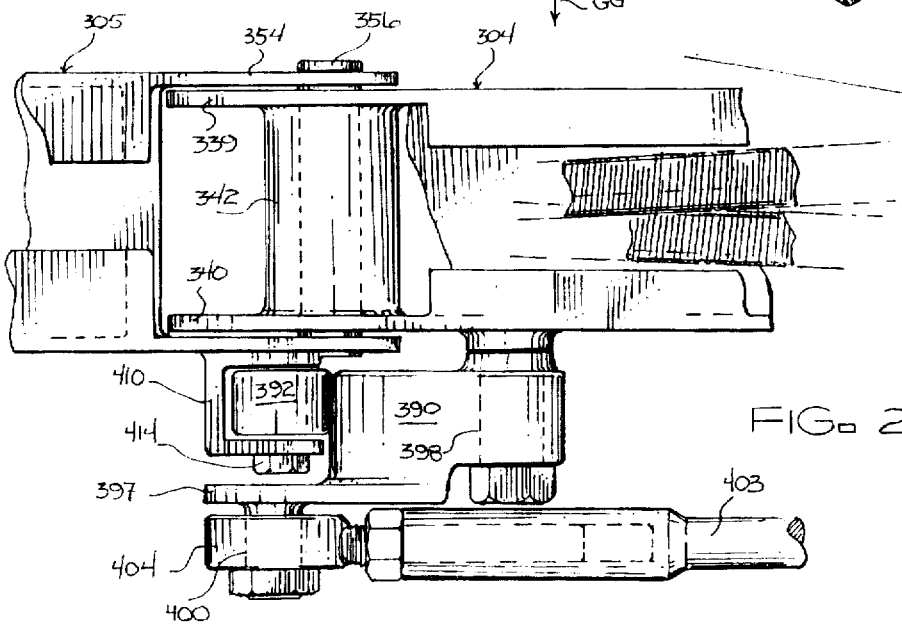
FIG. 20 is an enlarged portion illustrating the extend means.

Still referring to FIG. 19, with additional reference to FIG. 20, extension means 314 for extending outer arm 305 with respect to inner arm 304, in this embodiment, includes a cam 390 and cam follower 392. Cam 390 includes a convex contact surface 393 and an opposing concave contact surface 394 separated by a lobe 395, and a lever arm 397 extending outwardly therefrom. Cam 390 is preferably journaled on a post 398 having a threaded end 399, and secured by a nut threaded onto threaded end 399. Post 398 extends substantially perpendicularly downwardly from lower ear 340 along an axis designated by arrowed line FF. A stud 400 having a threaded end 402 extends downward from lever arm 397 along an axis designated by arrowed line GG, parallel to and spaced from axis FF. A compression member 403 having an end terminating in an eye 404, and an opposing end terminating in an eye 405 is coupled between cam 390 and extension 316 for rotating cam 390 between an inwardly rotated position and an outwardly rotated position. Eyes 404 and 405 are preferably adjustably attached, permitting adjustment of the length of compression member 403. Eye 404 is pivotally received about stud 400 and secured by a nut threaded onto threaded end 402. Eye 405 is pivotally received about a post 407 having a threaded end 408 extending downwardly from extension 316 and secured by a nut threaded onto threaded end 408.

A bifurcated bracket 410 having a bore 412 (not visible) extending therethrough is coupled to bottom wall 350 at inner end 352 of outer arm 305 and receives cam follower 392 which is generally cylindrical and has a bore 413 therethrough. A bolt 414 concurrently extends through bores 412 and 413 along an axis designated by arrowed line HH, parallel to and spaced from axis FF and GG, securing cam follower 392 within bracket 410 on a plane with cam 390.

Figure 22:
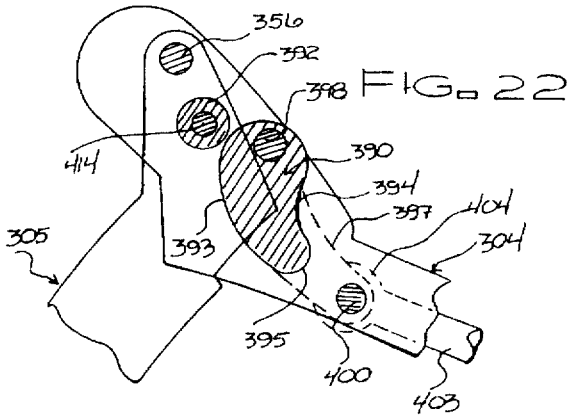
FIGS. 22–25 are diagrammatic views illustrating the operation of the extend means.
Figure 23:
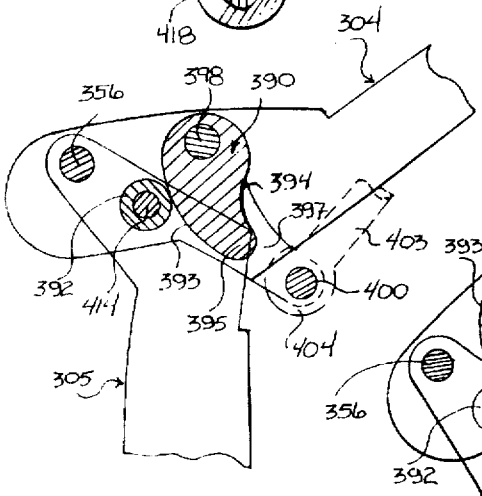

Turning to FIGS. 22–25, the operation of extension means 314 is illustrated, showing progressive stages of extension. Referring specifically to FIG. 22, gripping member 302 is shown in the fully release position of FIG. 16, with inner arm 304 retracted and outer arm 305 retracted. In this position, cam follower 392 contacts convex surface 393 of cam 390 which is in the inwardly rotated position. As actuating means 310 rotates inner arm 304 inward, compression member 403 pushes against lever arm 397 rotating cam 390 to the outwardly rotated position. The outward rotation of cam 390 can be seen in FIGS. 22–24 and forces cam follower 392 around convex surface 393 to the apex of lobe 395. The movement of cam follower 392 around convex surface 393, extends outer arm 305 outwardly against the bias of tensioning means 313. Over extension of outer arm 305 is prevented by the bias generated by tensioning means 313 and as an additional precaution by stop member 344, which prevents further outward rotation of outer arm 305.

Figure 24:
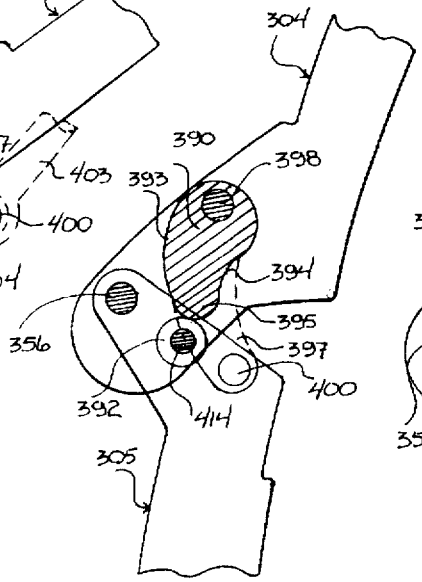
Figure 25:
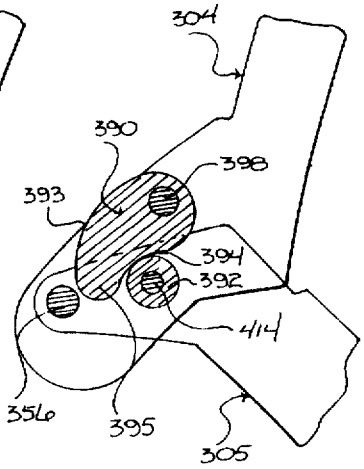

The position shown in FIG. 24, with cam follower 392 contacting the apex of lobe 395, marks the full extension of outer arm 305. Upon further extension of inner arm 304 to the fully extended position, cam follower 392 clears lobe 395. The bias generated by tensioning means 313 is now able to pull outer arm 305 inward to embrace a refuse container, with cam follower 392 moving along concave surface 394 as shown in FIG. 25.

Figure 21:
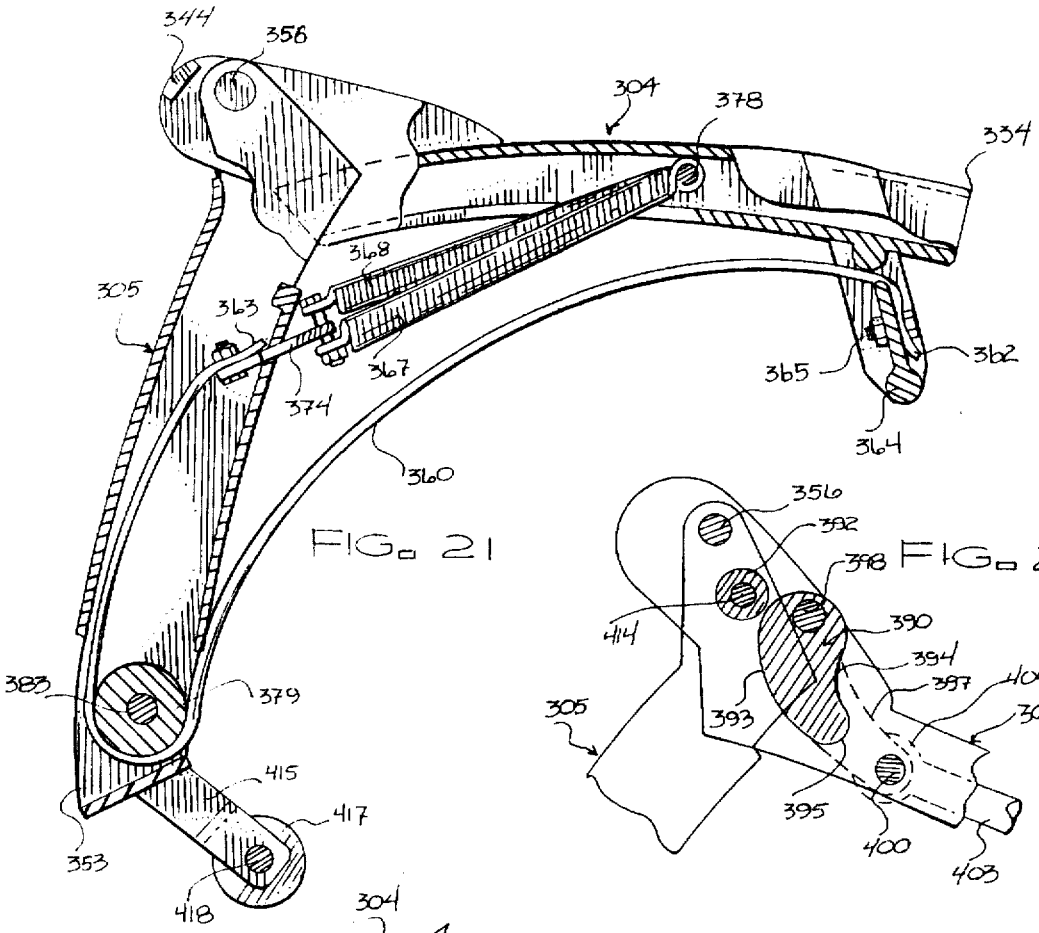
FIG. 21 is a partial sectional top view of a gripping member of the gripping apparatus of FIG. 16.
Figure 26:
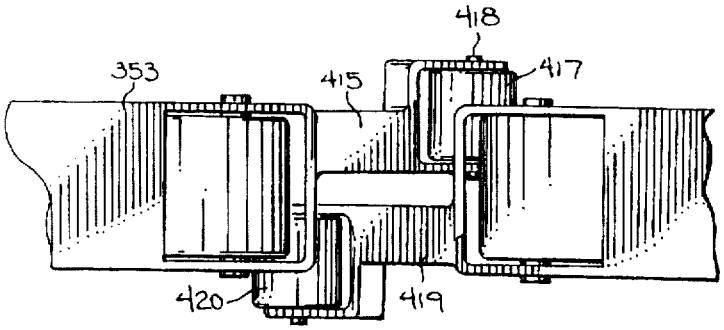
FIG. 26 is an enlarged segmentary view of the roller ends of the gripping members.

Referring to FIGS. 19, 21 and 26, a bifurcated bracket 415 extends from outer end 353 of outer arm 305, coincidentally the outer end of gripping member 302. A bore 416 extends through bracket 415. A roller 417 is rotatably supported within bracket 415 by a pin 418 which passes through bore 416. Bifurcated bracket 415 is turned angularly inward and offset upward, proximate top wall 349. A bifurcated bracket 419 similarly extends from the outer end of outer arm 308 and rotatably supports a roller 420, but is conversely offset in the downward direction. The offset positioning of rollers 417 and 420 allows them to overlap when in the gripping position as shown in FIG. 26.

Figure 27:
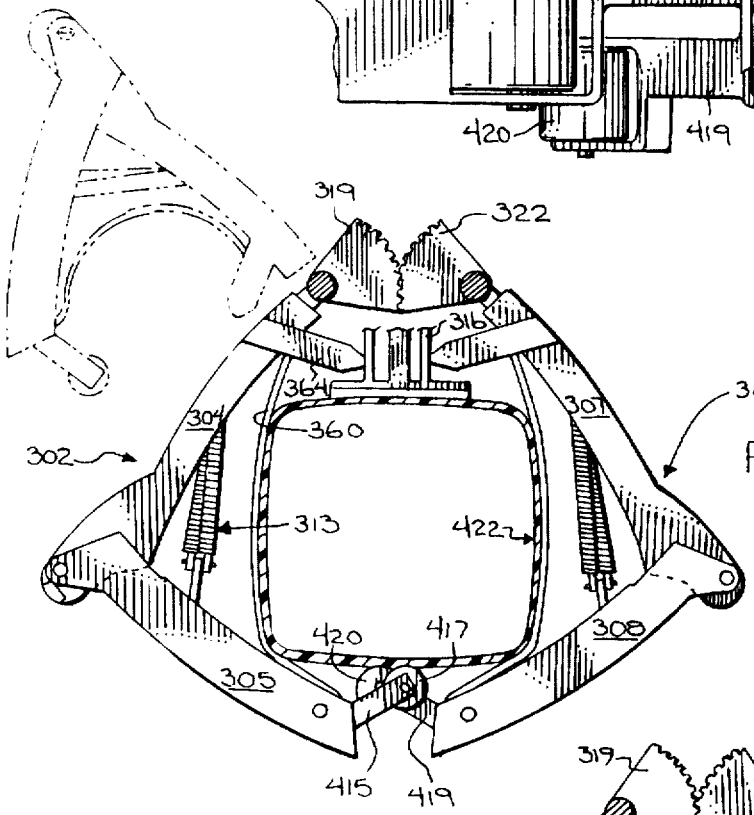
FIG. 27 is a top plan view illustrating the gripping apparatus of FIG. 16 in an extended position gripping a refuse container, and further illustrating in broken out line a gripping member in retracted position.

Referring now to FIG. 27, gripping apparatus 300 is illustrated gripping a relatively small refuse container 422. As outer arms 305 and 308 are pivoted inward by tensioning means 313, into gripping engagement with container 422, rollers 417 and 420 press refuse container 422 securely against pad 315. Since rollers 417 and 420 are able to overlap, smaller containers such as refuse container 422 illustrated are capable of being gripped. The smaller size of refuse container 422 extends the biasing means a relatively small distance, resulting in a reduced inward pulling force exerted on outer arms 305 and 308 by tensioning means 313. The gripping force applied, is sufficient to securely grip smaller refuse container 422 without causing damage or deformation thereto. To provide a completely secure grip, flexible member 360 contacts the sides of refuse container 422. The broken outline illustrates gripping member 302 in the full release or travel position.

Figure 28:
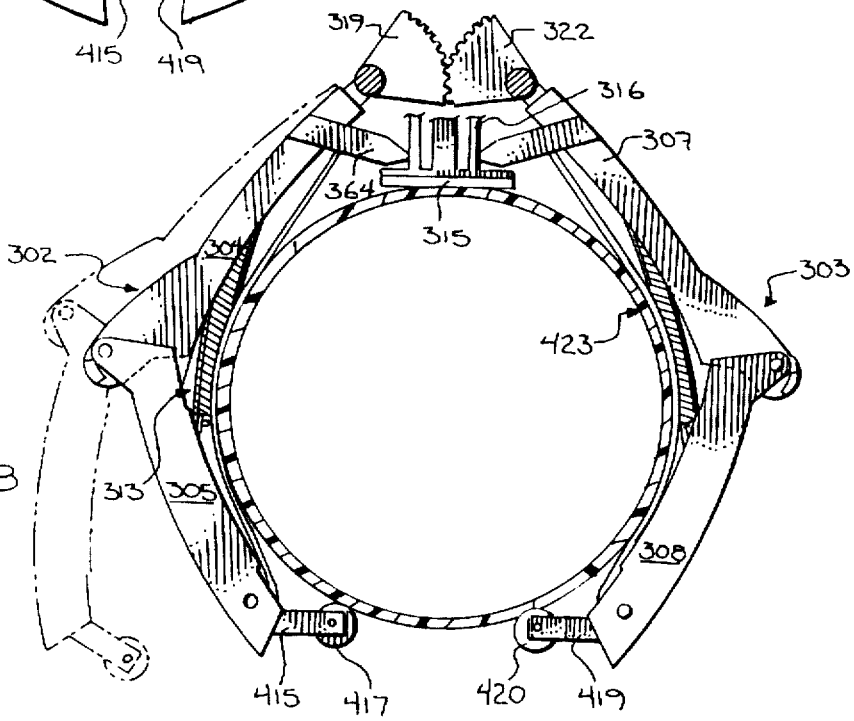
FIG. 28 is a top plan view illustrating the gripping apparatus of FIG. 16 in a gripping position, gripping a refuse container, and further illustrating in broken out line a gripping member in a position midway between the retracted and extended position.

When a larger refuse container 423 is gripped, such as illustrated in FIG. 28, the biasing means is stretched further. Therefore tensioning means 313 pulls outer arms 305 and 308 inward with greater force, holding refuse container 423 against pad 315 with the greater force necessary to secure a larger and heavier refuse container. The broken line in FIG. 28 illustrates gripping member 302 with outer arm 305 in the fully extended position, just prior to tensioning means pulling it into gripping engagement with refuse container 423.

Figure 29:
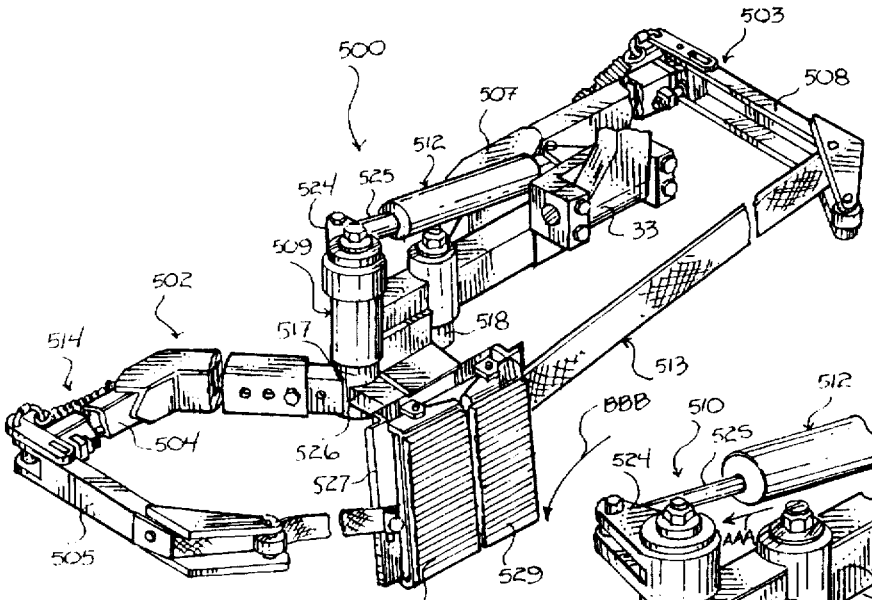
FIG. 29 is a fragmentary perspective view of a further embodiment of a gripping apparatus embodying the principles of the instant invention, the gripping apparatus being illustrated as it would appear in a retracted position.

Turning now to FIG. 29, a further embodiment of a gripping apparatus generally designated 500 is illustrated. It will be understood by those skilled in the art that gripping apparatus 500 may be carried by the outboard terminal portion of boom 33 as is gripping apparatus 40 illustrated in FIG. 1. Gripping apparatus 500 includes first and second gripping members 502 and 503 respectively, which are illustrated in the extreme is release or travel position.

Briefly, gripping member 502 includes inner arm 504 and pivotally connected outer arm 505. Gripping member 503 similarly includes inner arm 507 and pivotally attached outer arm 508. The pivotal connection between each inner arm and the respective outer arm is rotatable about a substantially vertical axis.

A pedestal 509, carried by boom 33, pivotally supports the inner end of each gripping member for rotation about a substantially vertical axis. Actuating means generally designated by the reference character 510, including hydraulic cylinder assembly 512, rotates gripping members 502 and 503 relative pedestal 509. More specifically, actuating means 510 moves the inner arms between the retracted position and the extended position. Tensioning means, generally designated by the reference character 513, moves each outer arm inwardly relative the respective inner arm and assists gripping members 502 and 503 in grasping and holding a refuse container, distributing the gripping force substantially equally around the periphery of the refuse container. Extension means, generally designated 514 moves each outer arm outwardly relative the respective inner arm. An extension 526 projects substantially horizontally outward from pedestal 509, and includes a substantially vertical plate 527 which pivotally supports a pair of pads 528 and 529 for receiving the refuse container thereagainst. Further description of the foregoing elements will be made presently.

During travel of vehicle 20, gripping apparatus 500 is stored in a manner similar to that illustrated for apparatus 40 in FIG. 2.

Figure 31:
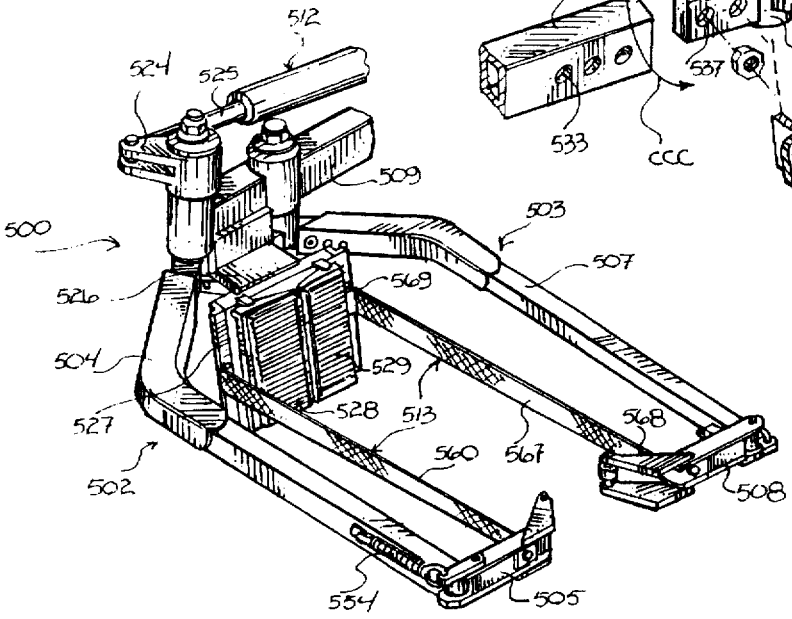
FIG. 31 is a perspective view of the gripping apparatus of FIG. 29 illustrated in the extended position.

Actuating means 510 is carried by pedestal 509. Actuating means 510 includes first and second shafts 517 and 518 which are parallel and rotatably journaled within pedestal 509. Segment gear 519 and mounting bracket 520 are carried by shaft 517 for rotation therewith. Similarly, segment gear 522 and mounting bracket 523 are carried by shaft 518. Segment gear 522 intermeshes with segment gear 519, and is caused to rotate therewith. In this embodiment, mounting bracket 523 is carried at a level slightly lower than mounting bracket 520. This has the effect of gripping member 503 being carried at a level lower than gripping member 502. The different levels thus produced, allow gripping members 502 and 503 to overlap when in the grip position, especially useful for gripping small containers. This effect may also be obtained by tilting one gripping member in an upward direction, and the other in a downward direction, or by bending either or both gripping members in an upward and downward direction. A lever 524 is drivingly engaged at one end thereof, to shaft 517. An operating rod 525 of hydraulic cylinder assembly 512 is pivotally connected to the other end of lever 524. Gripping apparatus 500 is moveable between a release position and a gripping position. The release position is illustrated in FIG. 29, the gripping position is illustrated in FIG. 31. In response to movement of operating rod 525 in the direction of arrowed line AAA, lever 524 is caused to move in the direction of arrowed line BBB urging counter rotation of shafts 517 and 518. Accordingly, mounting brackets 520 and 523 move in the directions indicated by arrowed lines CCC and DDD respectively, moving inner arms 504 and 507 to the extended position and gripping apparatus 500 to the gripping position of FIG. 31.

Each gripping member 502 and 503 is substantially a mirror image of the other. Accordingly, in the following detailed description it is to be understood that elements and function described in connection with one of the gripping members is correspondingly applicable to the other.

Figure 30:
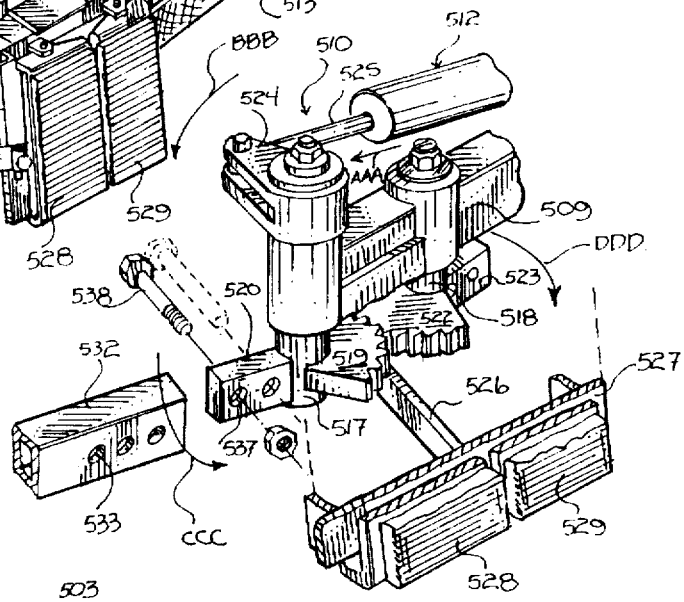
FIG. 30 is an enlarged fragmentary perspective view of the grip actuating assembly of the gripping apparatus of FIG. 29.
Figure 32:
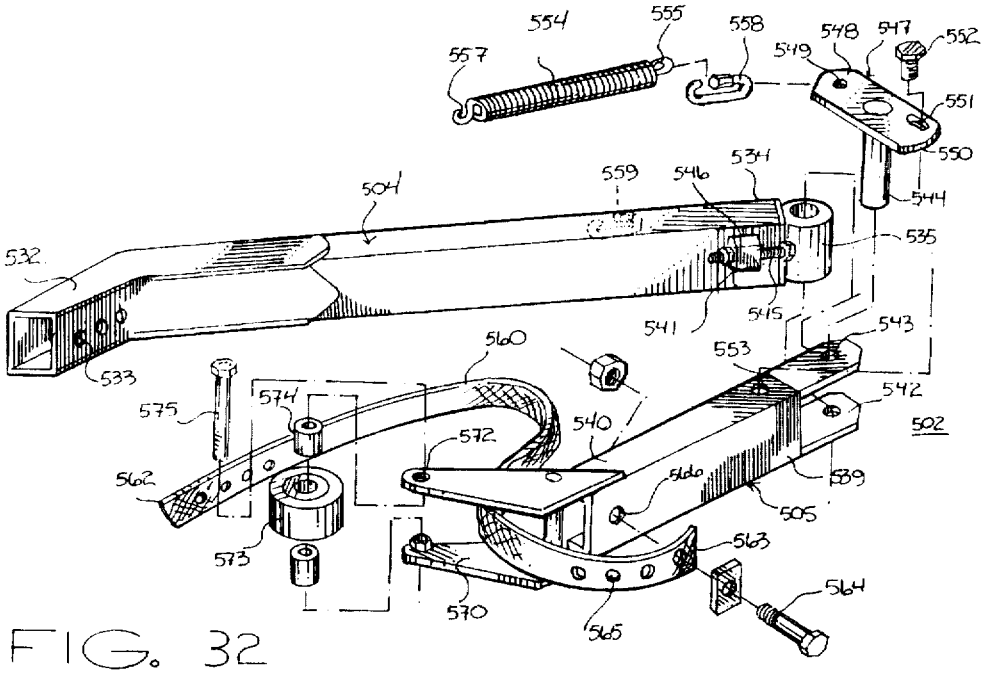
FIG. 32 is an exploded perspective view of a gripping member of the gripping apparatus of FIG. 29.

Turning now to FIG. 32, gripping member 503 is illustrated. Inner arm 507 of gripping member 503 is an elongate member, which in this embodiment is a substantially square tube having an inner end 532 through which a series of bores 533 extend, and an outer end 534 to which a lug 535 is affixed. With additional reference back to FIG. 30, inner arm 504 of gripping member 502 is coupled to mounting bracket 520. It will be understood that gripping member 503 is attached in a like manner, but for purposes of clarity of illustrations, inner end 532' of inner arm 504 is shown attached. The prime after the reference character identifies like elements for gripping member 502 with those of gripping member 503 described in greater detail in FIG. 32. Inner end 532' of first gripping member 502 is configured to receive mounting bracket 520 therein, so as to position one of bores 533' in alignment with a bore 537 extending through mounting bracket 520. A nut and bolt assembly 538 extends through bores 533' and 537, securing gripping member 502 to mounting bracket 520.

Outer arm 505 is an elongate member having an inner end 539 and an outer end 540. Inner end 539 of outer arm 505 terminates with a bifurcated bracket 542 extending outwardly therefrom, having a bore 543 therethrough. Bifurcated bracket 542 is configured to receive lug 535 therein. A pin 544 extends concurrently through bore 543 and lug 535, pivotally coupling outer arm 505 to inner arm 504. Pivotal inward movement of outer arm 505 is limited by an adjustable stop 541, consisting of a threaded bumper 545 received in a threaded coupling 546 attached to inner arm 504 proximate outer end 534.

In this embodiment, extension means 514 includes a plate 547 having an inner end 548 with a bore 549 therethrough and an outer end 550 with a bore 551 therethrough. Plate 547 is affixed to the top of pin 544, and positioned so as to extend parallel with the longitudinal axis of outer arm 505. Outer end 550 of plate 547 is secured to outer arm 505 by a bolt 552 extending through bore 551 into a bore 553 extending through outer arm 505 proximate inner end 539. A tension spring 554 having a first end 555 and a second end 557 is coupled between inner arm 504 and plate 547. A coupling member 558 is received by bore 549 of inner end 548 of plate 547 to join first end 555 of tension spring 554 thereto. A second coupling member 559 illustrated in broken outline, joins second end 557 of tension spring 554 to an outer surface of inner arm 504. The bias of tension spring 554 acts on inner end 548, keeping outer arm 505 in the extended position.

With reference to FIGS. 31 and 32, tensioning means 513 is a flexible member 560, having a first end 562 coupled to vertical plate 527 proximate a lower edge and a second end 563 adjustably coupled to outer arm 505 proximate outer end 540. Second end 563 is coupled to outer arm 505 by a nut and bolt assembly 564 extending through one of a series of bores 565 formed in second end 563 and bore 566 formed in outer arm 505 proximate outer end 540. Tensioning means 513 further includes a flexible member 567 having a first end 568 and a second end 569 coupled between outer arm 508 of gripping member 503 and vertical plate 527 respectively. Flexible member 567 is substantially identical to flexible member 560, with the exception that second end 569 is coupled to vertical plate 527 proximate an upper edge thereof. The different positioning of flexible members 560 and 567 are due to the positioning of gripping members 502 and 503. The lower placement of gripping member 503 requires a higher attachment of flexible member 567 in order for flexible members 560 and 567 to contact the sides of a gripped container at approximately the same level.

Still referring to FIG. 32, a bifurcated bracket 570 extends from outer end 540 of outer arm 505, coincidentally the outer end of gripping member 502. A bore 572 extends through bracket 570. A roller 573 with bearings 574 is rotatably supported within bracket 570 by a pin 575 which passes through bore 572. Bifurcated bracket 570 is turned angularly inward.

Figure 33:
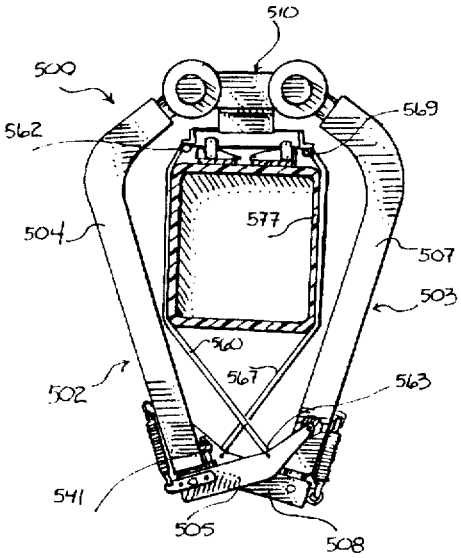
FIG. 33 is a top plan view of the gripping apparatus of FIG. 29 illustrated in an extended position, gripping a small refuse container.

Referring now to FIG. 33, gripping apparatus 500 is illustrated gripping a relatively small refuse container 577. As gripping members 502 and 503 are moved inward about container 577 by actuating means 510, refuse container 577 is pulled inwardly firmly against pads 528 and 529, and flexible members 560 and 567 of tensioning means 513 contact the sides of container 577 and are forced in an outwardly direction. Since belts 560 and 567 are of fixed length, and outer arms 505 and 508 are limited as to their respective inward movement by stop 541, this outward bend acts as biasing means, shortening the distance between first end 562 and second end 563 of flexible member 560 and first end 568 and second end 569 of flexible member 567. This results in outer arms 505 and 508 being pulled inward against the bias of extension means 514. When small containers such as illustrated are gripped, outer arms 505 and 508 overlap with flexible members 560 and 567, pulling the smaller container towards pads 528 and 529, and securely gripping the sides of container 577.

Figure 34:
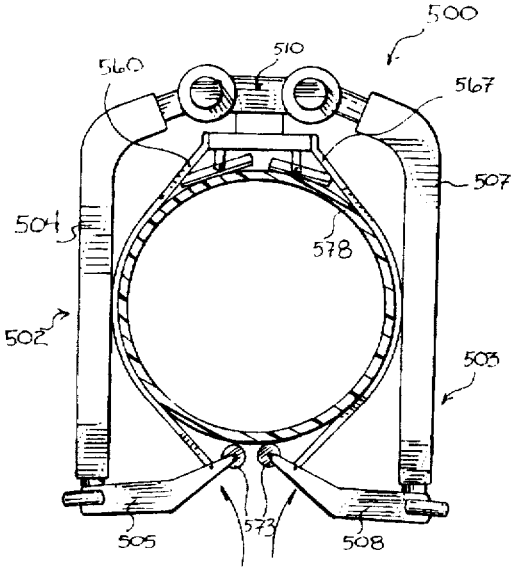
FIG. 34 is a top plan view of the gripping apparatus of FIG. 29 illustrated in the extended position, gripping a larger refuse container.

When a larger refuse container 578 is gripped, such as illustrated in FIG. 34, tensioning means 513 pulls outer arms 505 and 508 inward, with rollers 573 of outer arm 505 and 508 pressing container 578 firmly against pads 528 and 529. The force of the grip can be increased by further extension of gripping members 502 and 503, which increases the force with which tensioning means 513 pulls outer arms 505 and 508 inward against container 578.

Figure 35:
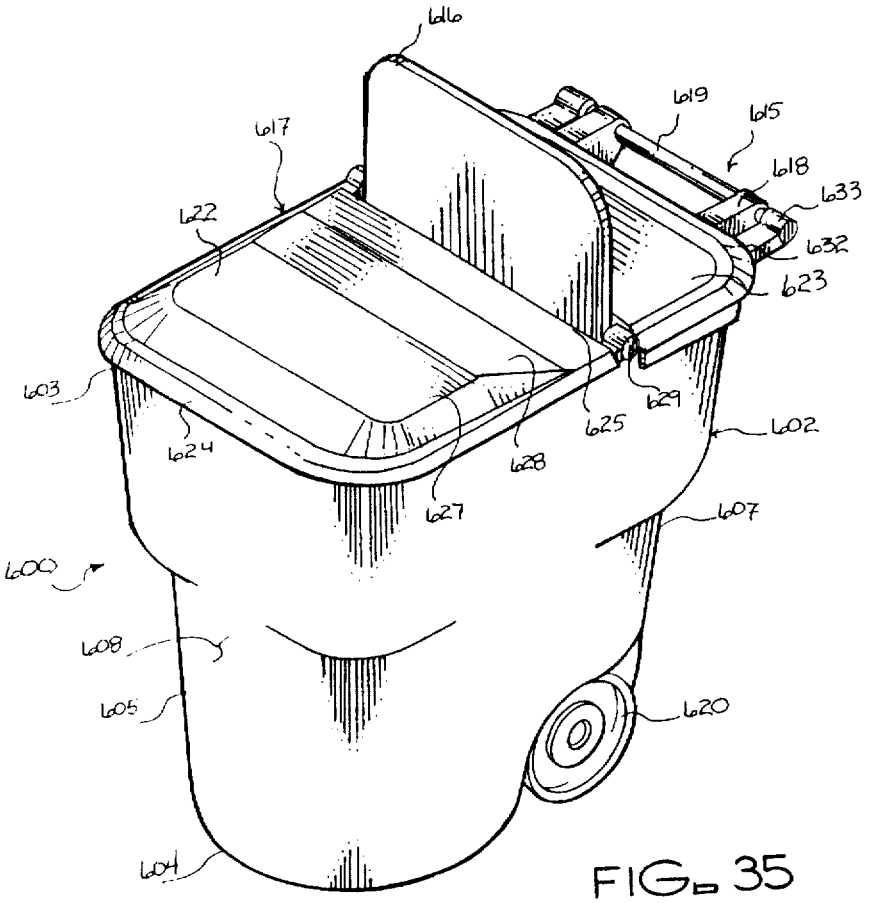
FIG. 35 is a perspective view of a self aligning container, embodying the principles of the instant invention.

Turning now to FIG. 35, a self-aligning container generally designated 600 is illustrated. Self-aligning container 600 is preferably handled by the gripping apparatus disclosed previously, but one skilled in the art will appreciate that substantially any gripping apparatus which acts in a similar manner to that described above, specifically gripping apparatus which draw the container into a clasping engagement, may be utilized.

Figure 37:
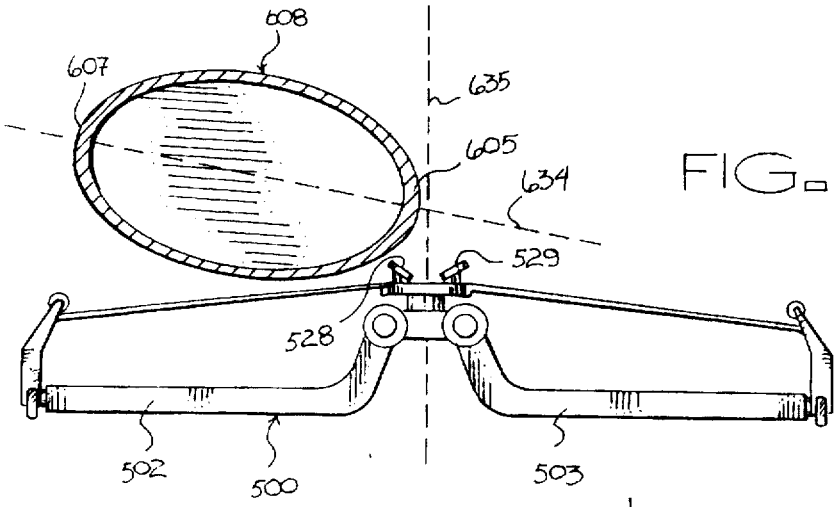
FIGS. 37–39 illustrate the aligning of a self aligning container as it is gripped by a gripping apparatus.
Figure 38:
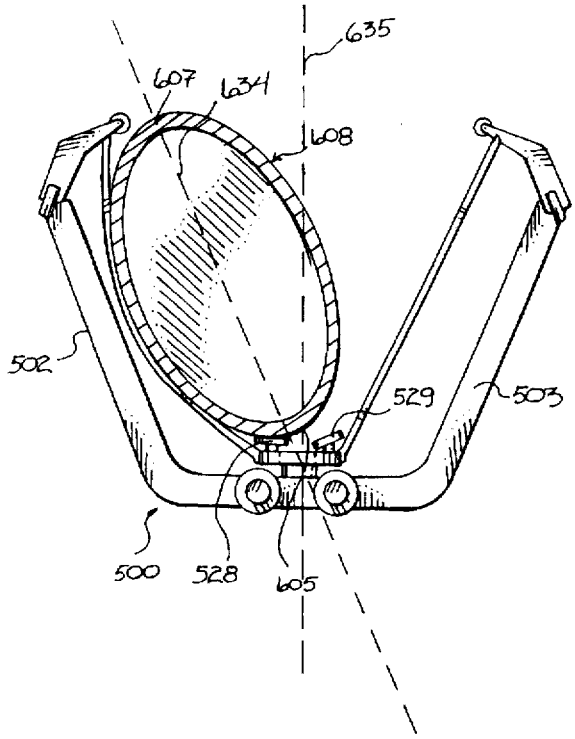
Figure 39:
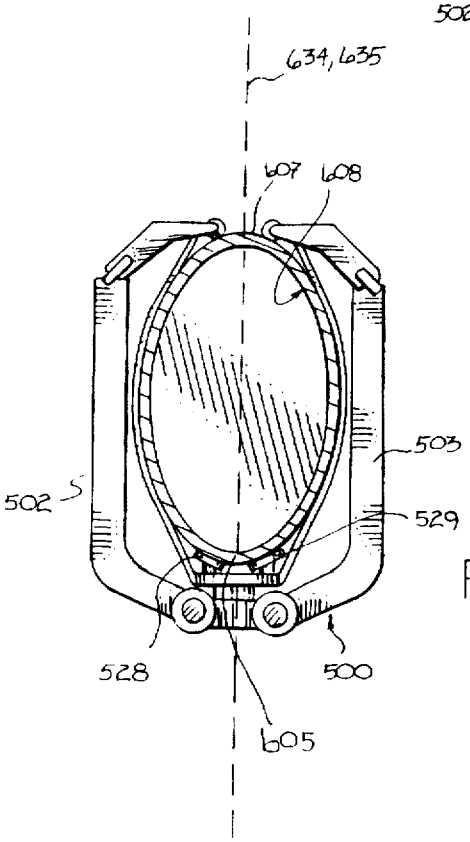
Figure 40:
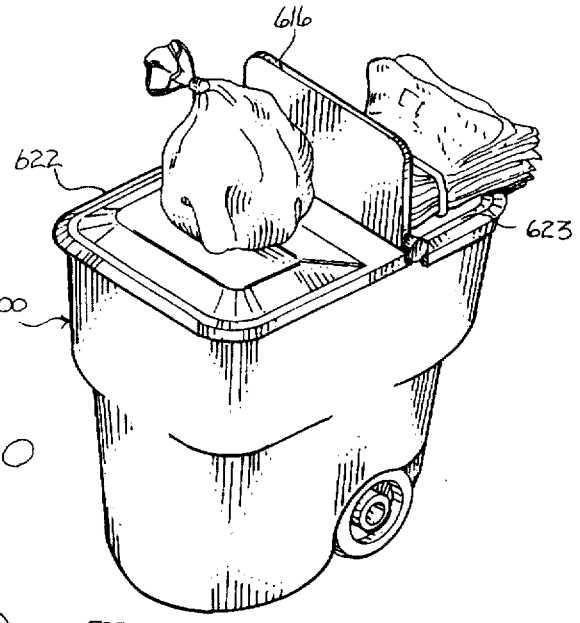
FIG. 40 is a perspective view illustrating the use of the overload panel.

Container 600 includes a body 602 having an open top 603, a closed bottom 604, a front or curb end 605 and a rear end 607. Body 602 is preferably constructed as a single piece, having a gripping portion 608 positioned intermediate top 603 and bottom 604, configured and placed to be engaged by gripping apparatus. Gripping portion 608 is substantially oval in cross-section as can be seen in FIGS. 37–39. For purposes of this specification, the term oval includes ovoid, elliptical, or any curved geometry other than spherical, without any large flat expanses, and being generally curvilinear throughout. To facilitate self alignment, it is only necessary for gripping portion to be oval. Body 602 adjacent top 603 or bottom 604 may be substantially any shape as long as the gripping apparatus is not interfered with. Furthermore, while container 600 is illustrated and described as having gripping portion 608 intermediate top 603 and bottom 604, one skilled in the art will realize that gripping portion 608 may be enlarged to be compatible with gripping apparatus which engage container 600 in different locations. Alternatively, gripping portion 608 may be positioned adjacent top 603 or bottom 604 depending upon the location engaged by the gripping apparatus.

Figure 36:
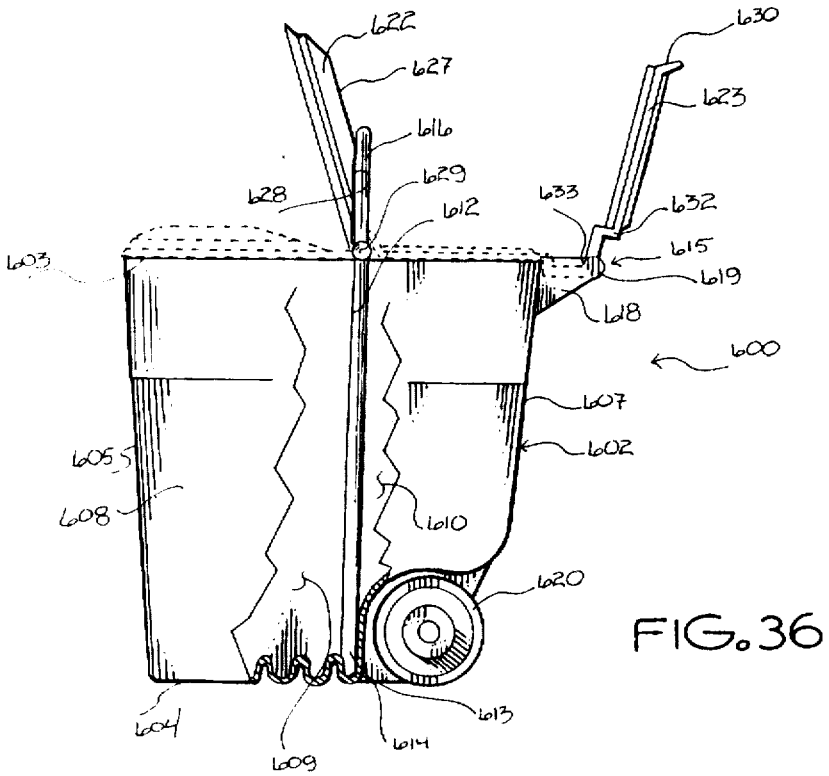
FIG. 36 is a partial cut-away side view of the self aligning container of FIG. 35.

With additional reference to FIG. 36, body 602 is divided into separate compartments, a front compartment 609 and a rear compartment 610, by a divider panel 612. Divider panel 612 is a generally planar panel with a lower end 613 which engages a notch 614 formed in bottom 604. Bottom 604 may be formed with a plurality of notches 614 between front end 605 and rear end 607, allowing for customizing adjustments to be made to divider panel 612. The adjustability of divider panel 612 allows front compartment 609 and rear compartment 610 to be varied in relative size according to the requirements of the user.

Container 600 further includes a handle assembly 615 extending from rear end 607 proximate open top 603 to allow manipulation of container 600 by an individual, a lid assembly 617 for closing open top 603, and an overload panel 616 extending upward from divider panel 112 through lid assembly 617 in an upright manner. Handle assembly 615 includes a pair of spaced apart brackets 618, extending from rear end 607 proximate open top 603. A generally horizontal bar 619 extends between and is supported by brackets 618. To further aid in manipulation of container 600, a pair of wheels 620 are coupled to bottom 604 of container 600 adjacent rear end 607 in a conventional manner, well known to those skilled in the art.

Still referring to FIGS. 35 and 36, lid assembly 617 includes a front lid 622 and a rear lid 623 separated by overload panel 616. Front lid 622 is sized to cover and close open top 603 corresponding to front compartment 609 and rear lid 623 is sized to cover and close open top 603 corresponding to rear compartment 610. Front and rear lids 622 and 623 may vary in size to correspond to open top 603 at front compartment 609 and rear compartment 610 when container 600 is customized by moving divider panel 612, adjusting the relative sizes of the compartments. Front lid 622 has a front edge 624, a rear edge 625, and a top surface 627 having a portion 628 sloping downward to rear edge 625. Front lid 622 is pivotally coupled to container 600 by hinges 629 mounted on opposing sides of divider panel 612. Front lid 622 is movable between a lowered position illustrated in FIG. 35, and a raised position illustrated in FIG. 36. In the raised position, sloped portion 628 of front lid 622 engages overload panel 616 arresting the movement of front lid 622 in a substantially upright position. Rear lid 623 includes a front edge 630 and a rear edge 632, and is pivotally coupled to container 600 by hinges 633 mounted on opposing sides of handle assembly 615. Preferably, hinges 633 are molded caps extending from rear edge 632 of rear lid 623 which are journaled about opposing ends of bar 619. Rear lid 623 is movable between a lowered position illustrated in FIG. 35, and a raised position, generally parallel to and spaced from front lid 622 in the upright position, illustrated in FIG. 36.

Turning now to FIG. 37, gripping apparatus 500, disclosed previously in FIGS. 29–34 is illustrated in the retracted position, prior to engaging container 600. Container 600 is shown with a cross-sectional top view, illustrating the oval shaped gripping portion 608. A bisecting line 634 is illustrated bisecting container 600 from front end 605 to back end 607, and a grip line 635 generally extending centrally from gripping apparatus 500 bisecting gripping apparatus along the loci of the vectors of force generated by gripping members 502 and 503. Bisecting line 634 and grip line 635 are illustrated solely for purposes of orientation and to provide points of reference. Proper orientation of container 600 for pick-up would be with front end 605 toward gripping apparatus 500, with bisecting line 634 in general alignment with and congruent to grip line 635. With this orientation, front and rear compartments 609 and 610 will empty into the appropriate stowage bin. However, as is frequently the case, container 600 is illustrated improperly placed for pick-up, with bisecting line 634 skewed with respect to grip line 635. The left side of the figure represents rear end 607 of container 600 with the right side representing front end 605. Gripping apparatus 500 is shown properly positioned for gripping self-aligning container 600, with grip line 635 extending outward proximate front end 605.

FIG. 38 illustrates gripping apparatus 500 extended into the gripping position. As gripping members 502 and 503 are extended, container 600 is drawn inward against pads 528 and 529. Container 600, in this example, is also pivoted by gripping members 502 and 503, orienting with front end 605 toward pads 528 and 529 so that bisecting line 634 becomes aligned with and congruent to grip line 635. Container 600 pivots about bottom 604 proximate front end 605. Wheels 620 aid in this pivoting movement by shifting the weight of the refuse slightly forward, toward front end 605 of container 600.

Turning next to FIG. 39, container 600 is shown fully engaged by gripping apparatus 500 in the correct orientation, with bisecting line 634 generally congruent to grip line 635. One skilled in the art will understand that container 600 may be misplaced in substantially any orientation other than a complete reverse of the proper orientation wherein rear end 607 is forward or to the curb side of front end 605.

As described previously, container 600 includes an overload panel 616 extending upward from divider panel 612 in an upright manner. This feature permits refuse to be stacked on top of lids 622 and 623 in the event accumulated refuse has a larger volume than container 600. Ordinarily, refuse stacked in this manner could not be directed into the appropriate stowage bin when dumped. With additional reference to FIG. 41, a refuse collection body 637 generally of the type mounted on refuse collection vehicles is illustrated. Collection body 637 is divided into separate bins 638 and 639 by a divider wall 640. An optional movable extension 641 extends from divider wall 640. One skilled in the art will appreciate that divider wall 640 may be a single member. Overload panel 616 is positioned to engage extension 641 of refuse collection body 637 when inverted by the container handling mechanism. Overload panel 616 directs the overloaded refuse into the appropriate bins.

Figure 41:
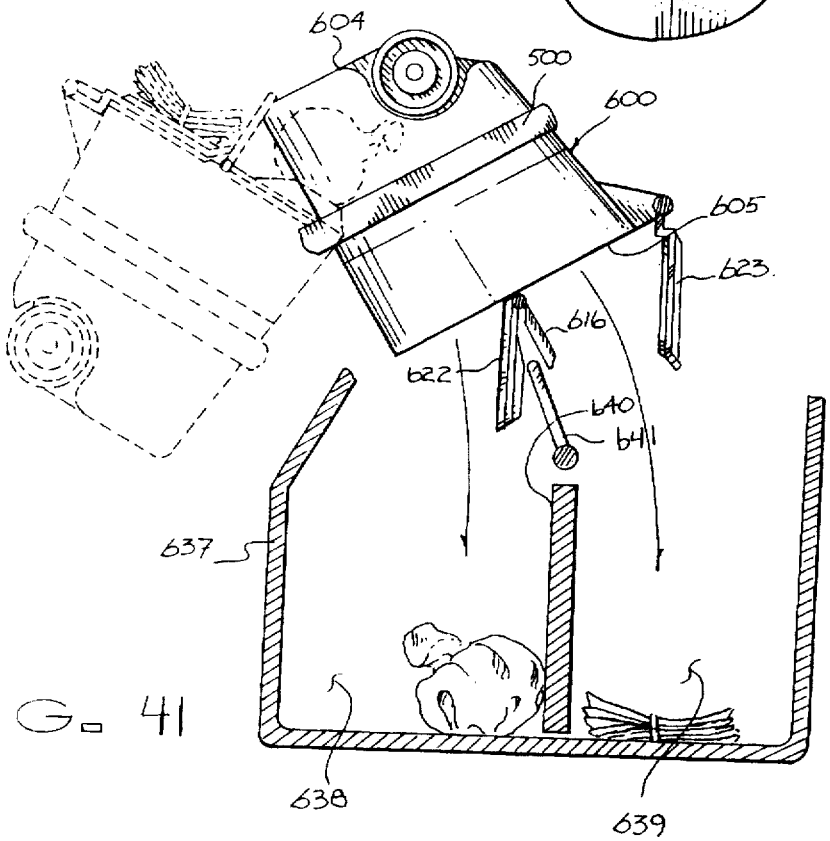
FIG. 41 is a side view illustrating the deposit of refuse from the self aligning refuse container into the proper bins of a collection body.

Still referring to FIG. 41, as container 600 is positioned over collection body 637, front lid 622 pivots open, directing refuse from front compartment 609 into stowage bin 638. Rear lid 623 also opens allowing refuse contained in rear compartment 610 to empty into stowage bin 639. Overload panel 616 provides the further service of engaging or residing proximate extension 641 and directing refuse from rear compartment 610 into bin 639, preventing mixing of refuse.

An alternate embodiment of a self aligning container generally designated 642 is illustrated in FIGS. 42 and 43. In generally similarity with container 600, container 642 includes a body 643 having an open top 644, a closed bottom 645 and a gripping portion 647, a lid assembly 648 coupled to open top 644, a divider panel (not shown), an overload panel 650, and a handle assembly 652. As described previously, the self-aligning containers constructed in accordance with the present invention all have gripping portions which are generally oval, in shape, the term oval being defined previously. FIGS. 42 and. 43 are present to illustrate a gripping portion which is, specifically oval in shape as opposed to the elliptical shape of container 600.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A method of collecting refuse comprising the steps of:

providing a container handling mechanism having a gripping apparatus with flexible gripping members and a grip line extending centrally from said gripping apparatus intermediate said flexible gripping members;

providing a container having an open top, a closed bottom, a front end, a back end, a bisecting line bisecting said container from said front end to said back end, and a gripping portion intermediate said open top and said closed bottom, said gripping portion being substantially oval in cross section; and engaging said gripping portion of said container with said gripping apparatus in a direction toward said front end of said container; whereby upon gripping of said gripping portion of said container with said gripping apparatus, said flexible gripping members engage said gripping portion causing said bisecting line of said container to orient substantially congruent with said grip line of said gripping apparatus with said front end directed toward said gripping apparatus.

2. A method as claimed in claim 1 wherein said step of providing a container further includes providing a container having a divider panel mounted within said body dividing said body into separate compartments, a lid assembly coupled to and closing said open top of said body, and an overload panel extending from said divider panel through said lid assembly in a substantially upright manner with respect thereto, to permit refuse to be carried atop said lid assembly, and further providing the steps of:

providing a refuse collection body divided into separate bins by a divider wall; and inverting said container with said container handling mechanism over said collection body with said open top directed toward said refuse collection body to empty each of said separate compartments of said container into said separate bins.

3. A method as claimed in claim 2 wherein said step of inverting further includes positioning said overload panel proximate said divider wall.

* * * * *